US007604577B2

(12) United States Patent
Lin

(10) Patent No.: US 7,604,577 B2
(45) **Date of Patent: *Oct. 20, 2009**

(54) ADJUSTABLE DUMBBELL AND METHOD

(75) Inventor: William Lin, Taichung (TW)

(73) Assignee: Asia Regent Limited, Taichung (TW)

( * ) Notice: Subject to any disclaimer, the term of this patent is extended or adjusted under 35 U.S.C. 154(b) by 121 days.

This patent is subject to a terminal disclaimer.

(21) Appl. No.: 11/702,673

(22) Filed: Feb. 6, 2007

(65) Prior Publication Data

US 2007/0254785 A1 Nov. 1, 2007

Related U.S. Application Data

(63) Continuation-in-part of application No. 11/350,169, filed on Feb. 8, 2006, now Pat. No. 7,413,533.

(51) Int. Cl.
*A63B 21/072* (2006.01)
*A63B 21/075* (2006.01)

(52) U.S. Cl. ..... 482/108; 482/106; 482/107

(58) Field of Classification Search ..... 482/106–108; *A63B 21/072, 21/075*
See application file for complete search history.

(56) References Cited

U.S. PATENT DOCUMENTS

| | | | | |
|---|---|---|---|---|
| 4,529,198 | A | 7/1985 | Hettick, Jr. | |
| 5,839,997 | A | 11/1998 | Roth et al. | |
| 5,876,313 | A | 3/1999 | Krull | |
| 6,039,678 | A | 3/2000 | Dawson | |
| 6,228,003 | B1 * | 5/2001 | Hald et al. | 482/107 |
| 6,261,022 | B1 | 7/2001 | Dalebout et al. | |
| 6,416,446 | B1 * | 7/2002 | Krull | 482/108 |
| 6,500,101 | B1 * | 12/2002 | Chen | 482/107 |
| 6,540,650 | B1 | 4/2003 | Krull | |
| 6,656,093 | B2 | 12/2003 | Chen | |
| 6,899,661 | B1 | 5/2005 | Krull | |
| 7,025,713 | B2 | 4/2006 | Dalebout et al. | |
| 7,090,625 | B2 | 8/2006 | Chermack | |
| 7,121,988 | B2 * | 10/2006 | Walkerdine | 482/106 |
| 7,137,932 | B2 * | 11/2006 | Doudiet | 482/107 |
| 7,223,214 | B2 * | 5/2007 | Chen | 482/107 |
| 7,413,533 | B2 * | 8/2008 | Lin | 482/108 |
| 2002/0183174 | A1 | 12/2002 | Chen | |
| 2003/0148862 | A1 | 8/2003 | Chen et al. | |
| 2004/0005969 | A1 | 1/2004 | Chen | |
| 2006/0105891 | A1 | 5/2006 | Cappellini et al. | |

* cited by examiner

*Primary Examiner*—Fenn C Mathew
*Assistant Examiner*—Andrew M Tecco
(74) *Attorney, Agent, or Firm*—Pillsbury Winthrop Shaw Pittman, LLP

(57) ABSTRACT

An adjustable dumbbell assembly of the type including two sets of weights, each including a radial opening extending from a central area to a peripheral area and at least one transversely extending opening in the central area communicating with said radial opening, and a weight supporting assembly operable to selectively connect and disconnect the two sets of weights thereto on opposite sides of a centrally located handle. The weight supporting assembly on each side includes a fixed weight supporting structure, movable weight selector structure, and manually turnable actuating structure. The structures are interrelated with respect to one another, so that when the fixed structure is in an operative position with respect to the weights, manually turning the actuating structure in one direction moves the selector structure in one direction and manually turning the actuating structure in an opposite direction moves the selector structure in the opposite direction.

26 Claims, 25 Drawing Sheets

ADJUSTABLE DUMBBELL AND METHOD

RELATED APPLICATIONS

This application is a continuation-in-part of U.S. patent application Ser. No. 11/350,169 filed Feb. 8, 2006, now U.S. Pat. No. 7,413,533 hereby incorporated by reference in its entirety, and for which priority is claimed, and this application further claims priority from Chinese Patent Application 200620157998.7, filed Nov. 17, 2006, also incorporated by reference in its entirety.

BACKGROUND OF THE INVENTION

1. Field of the Invention

The invention relates to exercise equipment, more particularly to an adjustable dumbbell.

2. Description of the Related Art

Referring to FIGS. 1 and 2, a conventional adjustable dumbbell 10, as disclosed in U.S. Pat. No. 6,656,093 (see also U.S. Patent Application Publication No. 2004/0005969), includes a base 11 for supporting a plurality of weights 12, a hollow handle 13, two latches 14, and two adjustable units 15.

Each of the weights 12 includes a lateral channel 121, and a vertical groove 122 communicating with the lateral channel 121. The lateral channel 121 has a width greater than that of the vertical groove 122.

The hollow handle 13 has two blocks 132 provided respectively on two opposite ends thereof for engaging the vertical grooves 122 of the weights 12, and two conduits 133 laterally and respectively formed in the middle portions of the blocks 132. Each of the blocks 132 includes a passage 135 communicating with the respective conduit 133, and a plurality of spaced-apart apertures 134 communicating with the passage 135. Each of the apertures 134 has a diameter greater than the width of the passage 135.

Each of the latches 14 is inserted slidably into one of the blocks 132 via the corresponding conduit 133, and has a screw hole 141.

Each of the adjustable units 15 is provided at each end of the hollow handle 13, and includes a barrel 151 having a catch 152 provided in a bottom portion thereof for insertion into one of the apertures 134 in the corresponding block 132, a spring 153 disposed in the barrel 151 for biasing the catch 152 to engage one of the apertures 134 and for selectively or adjustably securing the latches 14 to the respective blocks 132, and a bolt 154 passing through the barrel 151 to engage threadedly the screw hole 141 in the corresponding latch 14. The bolt 154 is limited to slide and move along the passage 135 of the corresponding block 132 so that each latch 14 may also be limited to move and slide relative to the respective block 132.

In operation, when the catch 152 of the barrel 151 of each adjustable unit 15 is disengaged from the corresponding aperture 134 by pulling the barrel 151. away from the corresponding block 132 against the spring 153, each latch 14 may be moved and adjusted relative to the corresponding block 132. When each latch 14 is moved to engage the lateral channels 121 of all of the weights 12 on one end of the hollow handle 13, these weights 20 are secured to the corresponding block 132. The number of the weights 12 at each end of the hollow handle 13 can be adjusted by simply moving the latches 14 relative to the blocks 132, respectively.

In the aforementioned conventional adjustable dumbbell 10, the two adjustable units 15 are operated separately, and the catches 152 of the barrels 151 have to accurately spring back into the corresponding apertures 134 in the blocks 132 when the barrels 151 are released by the user.

Referring to FIGS. 3 and 4, another conventional adjustable dumbbell 20 includes a plurality of weights 22 provided on each end of a hollow handle 21, and two adjustable units 23. The user operates the two adjustable units 23 to balance the number of the weights 22 at each end of the hollow handle 21.

SUMMARY OF THE INVENTION

One aspect of the present invention provides an adjustable dumbbell assembly including two sets of weights, each including a radial opening extending from a central area to a peripheral area and at least one transversely extending opening in the central area communicating with the radial opening, and a weight supporting assembly operable to selectively connect and disconnect the two sets of weights thereto on opposite sides of a centrally located handle.

The weight supporting assembly on each side includes a fixed weight supporting structure, movable weight selector structure, and manually turnable actuating structure. The fixed weight supporting structure is configured and positioned to enter within the radial openings of the weights and into an operative position with respect thereto. The movable weight selector structure is configured and positioned to enter axially in one direction into the at least one transverse opening of the selected weights when the fixed structure is in the operative position thereof with respect to the weights and to withdraw axially in an opposite direction out of the at least one transverse opening of selected weights when the fixed structure is in an operative position with respect to the weights. The manually turnable structure is positioned and configured to be manually grasped at the end of the side and turned in opposite directions about an axially extending turning axis. The structures are interrelated with respect to one another so that when the fixed structure is in an operative position with respect to the weights manually turning the actuating structure in one direction moves the selector structure in one direction and manually turning the actuating structure in an opposite direction moves the selector structure in the opposite direction.

According to another aspect of this invention, there is provided an adjustable dumbbell comprises a hollow handle having a connecting end and an adjustable weight supporting assembly including a screw rod extending into the hollow handle and operable to rotate relative to the hollow handle about a rotation axis, and a weight selector extending into the hollow handle and engaging threadedly the screw rod so as to be movable axially upon rotation of the screw rod about the rotation axis, the weight selector having a weight-supporting part extending outwardly through the connecting end of the hollow handle; and a plurality of weights, each of which is formed with an elongated radial opening having an enlarged central portion for extension of the weight-supporting part of the weight selector therethrough.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
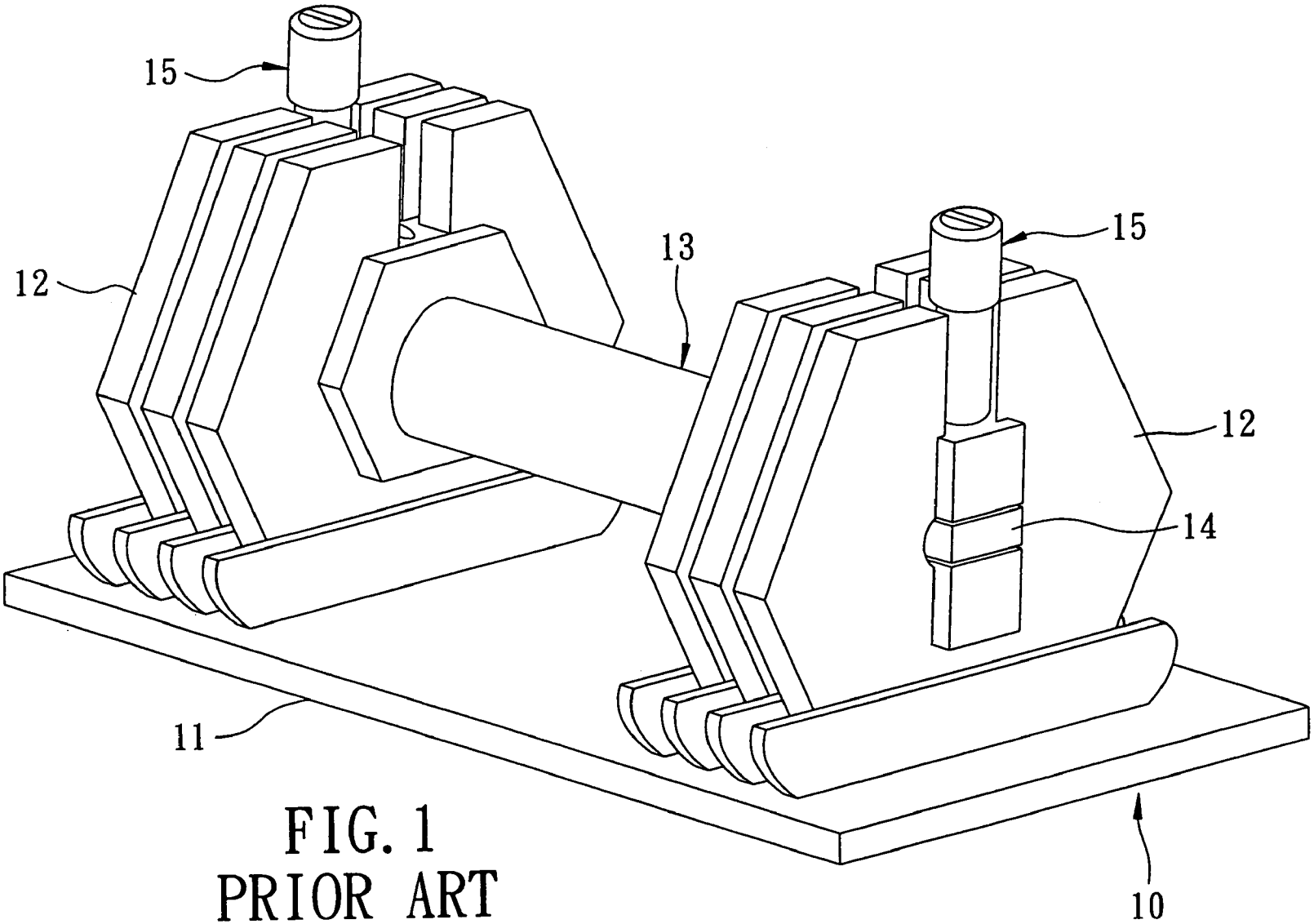
FIG. 1 PRIOR ART
FIG. 1 is a perspective view of a conventional adjustable dumbbell disclosed in U.S. Pat. No. 6,656,093.
Figure 2:
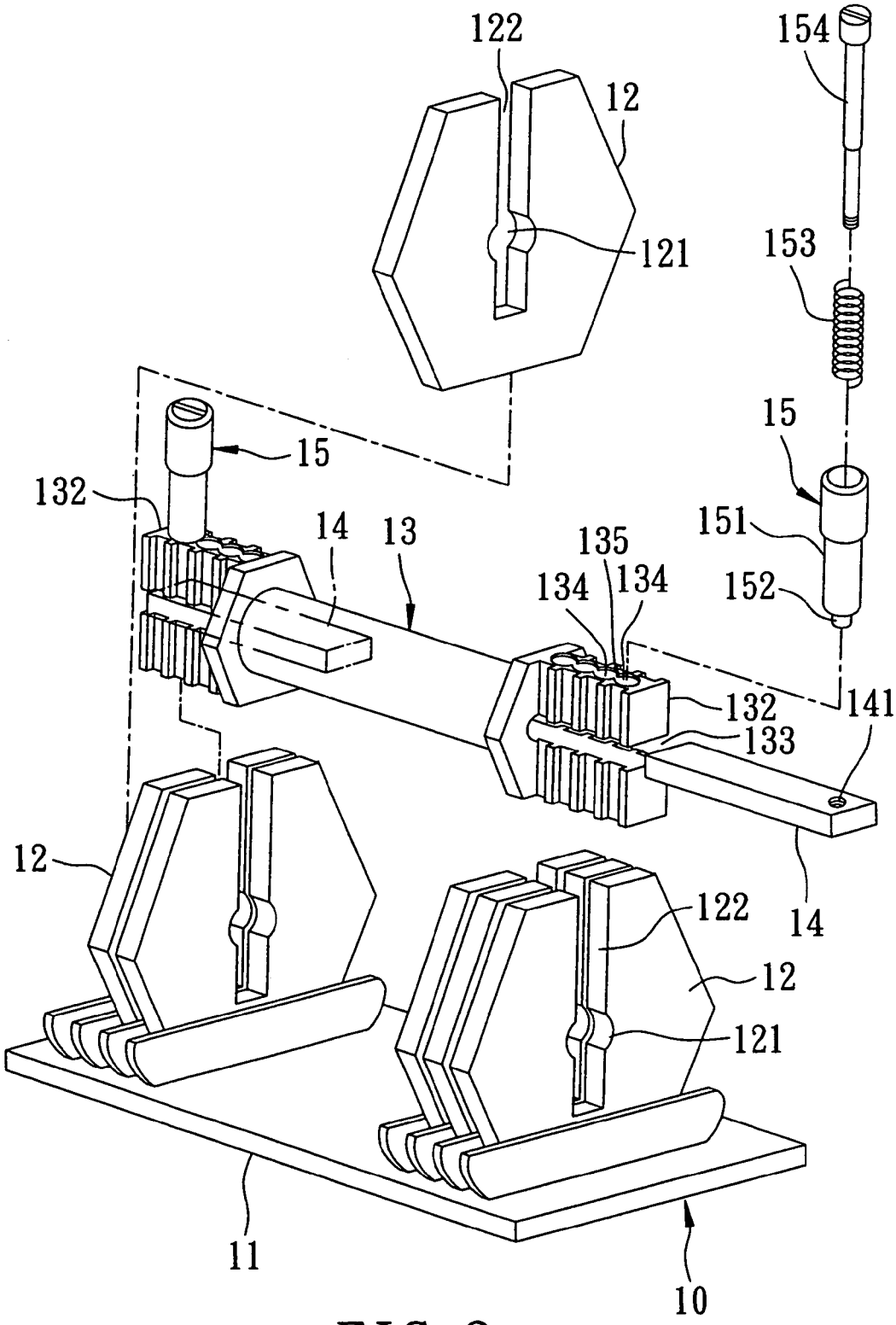
FIG. 2 PRIOR ART
FIG. 2 is a partly exploded perspective view of the conventional adjustable dumbbell of FIG. 1.
Figure 3:
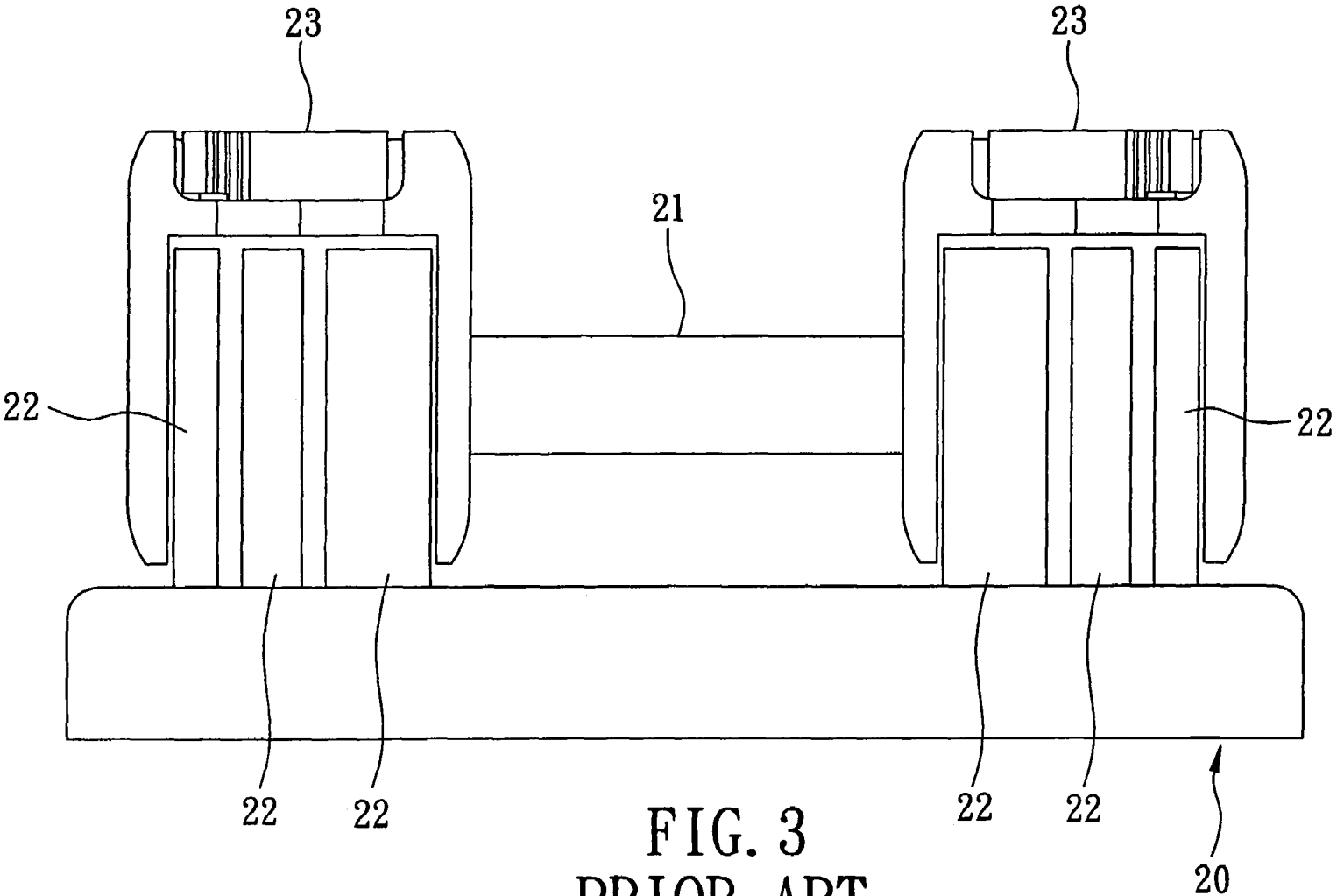
FIG. 3 PRIOR ART
FIG. 3 is a schematic front view of another conventional adjustable dumbbell.
Figure 4:
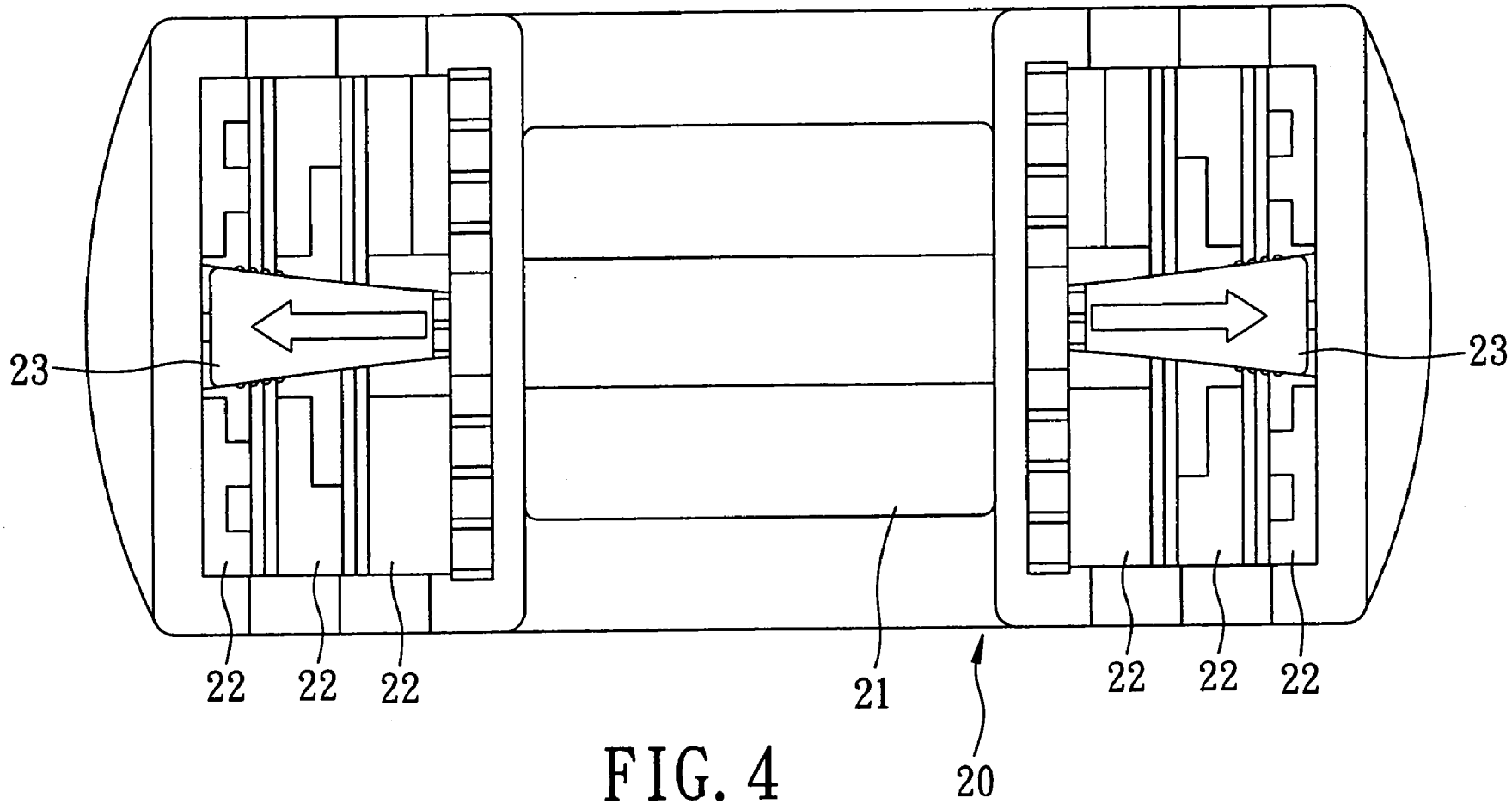
FIG. 4 PRIOR ART
FIG. 4 is a schematic top view of the conventional adjustable dumbbell of FIG. 3.
Figure 5:
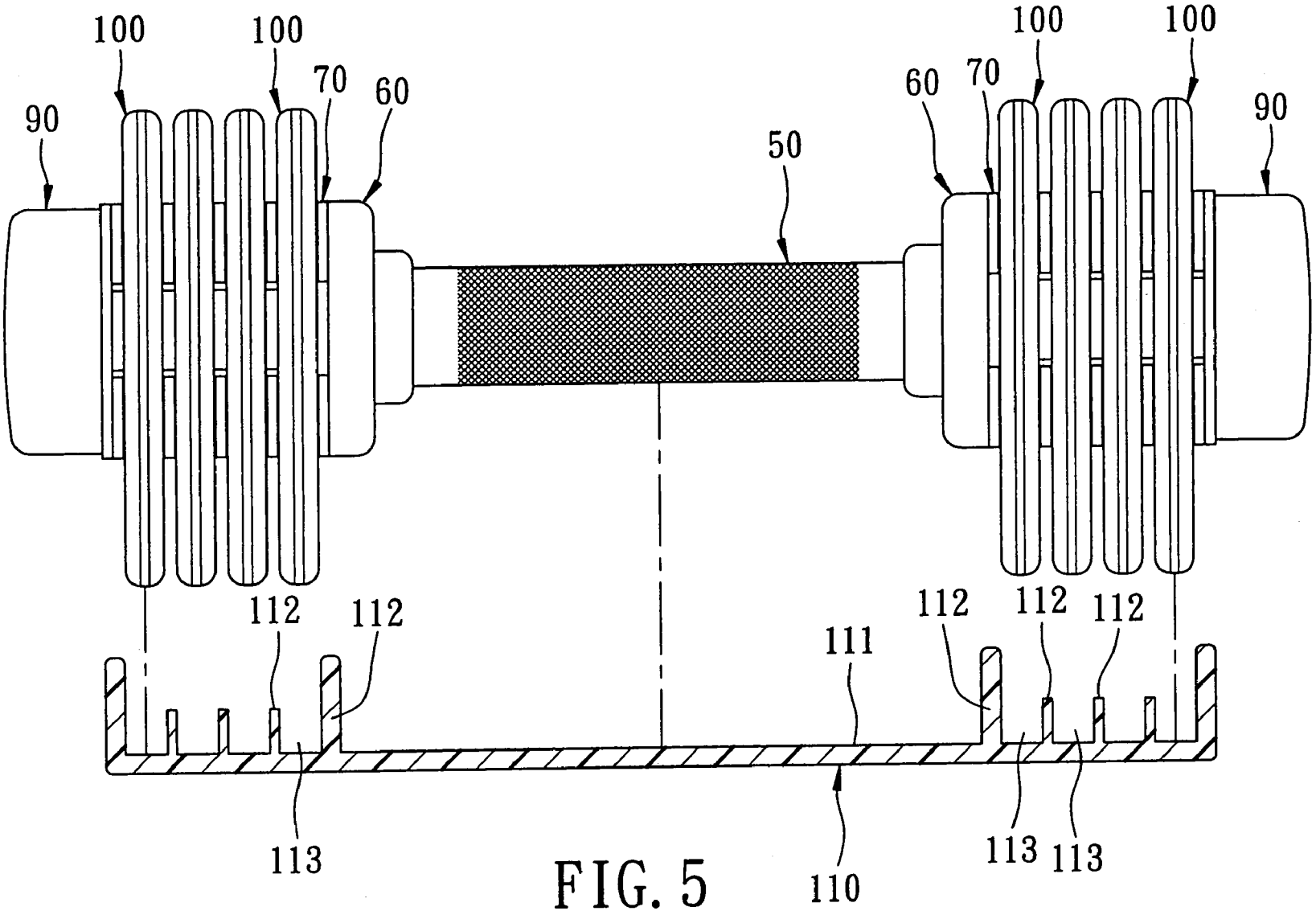
FIG. 5 is a schematic partly sectional side view of the first embodiment of an adjustable dumbbell according to the present invention.
Figure 6:
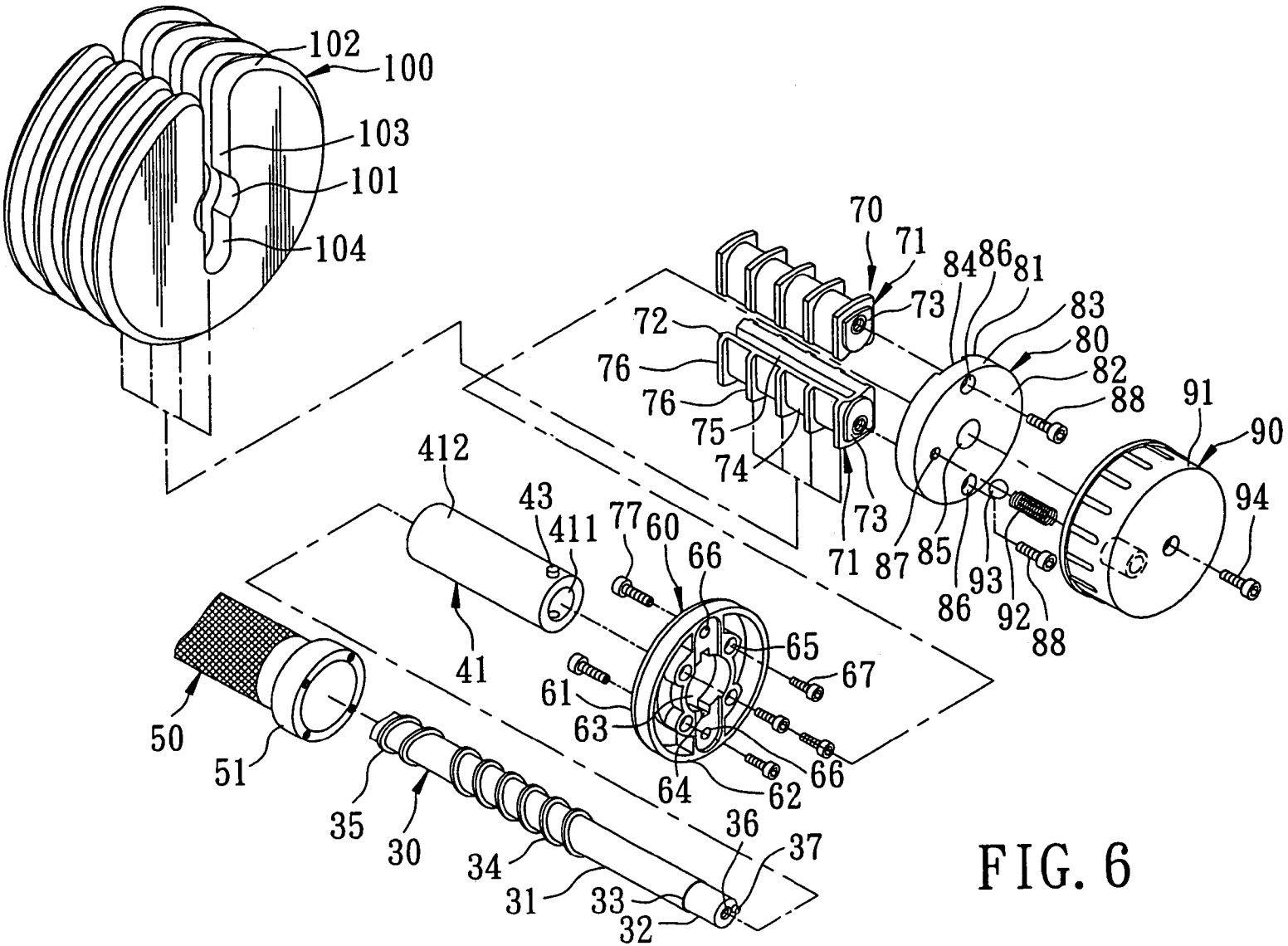
FIG. 6 is a fragmentary exploded perspective view of the first embodiment.
Figure 7:
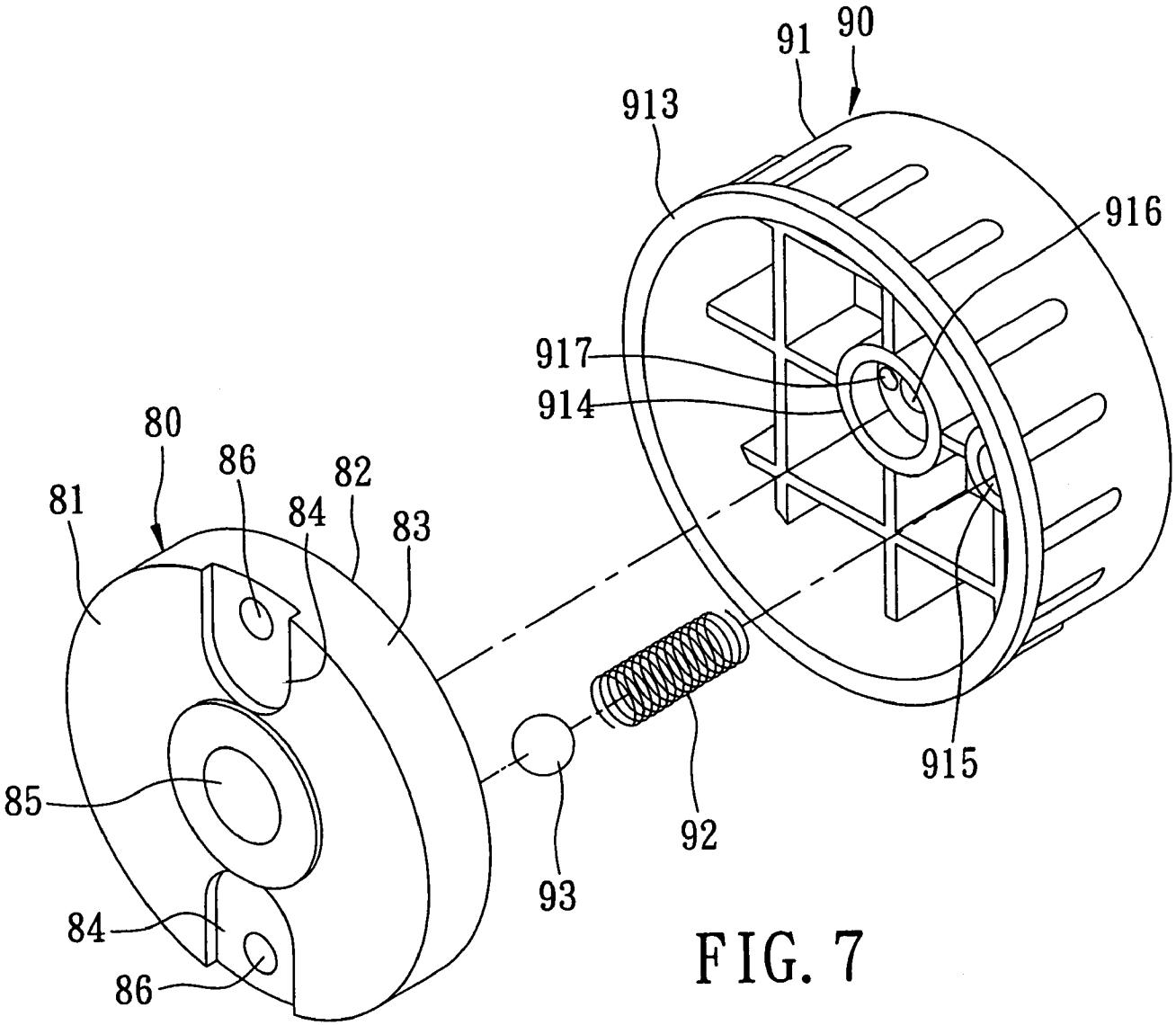
FIG. 7 is an exploded perspective view of an adjustment knob unit of the first embodiment.

Referring to FIGS. 5 to 10, a first embodiment of an adjustable dumbbell according to the present invention is best shown in exploded view of FIG. 6 to comprise a shaft or screw rod 30, two selector tubes or weight carriers 41, 42, a hollow handle in the form of a hollow grip bar or tube 50, two first covers or inner fastening members 60, two support units or limiting member seats 70, two adjustment knob units or operating caps 90, two sets of weights 100, and a base or mounting seat 110 (see FIG. 5).

The hollow handle 50, the fastening members 60 and the two support units 70 constitute fixed weight supporting structure for supporting the two sets of weights 100 on opposite sides of a central handle provided by the hollow handle 50. The two selector tubes 41 and 42 constitute movable weight selector structure for selectively connecting and disconnecting a selected number of weights 100 to the fixed weight supporting structure 50, 60 and 70. The shaft 30 and the two adjustment knob units 90 constitute manually turnable actuating structure for moving the weight selector structure 41-42. The fixed weight supporting structure 50, 60 and 70, the movable weight selector structure 41 and 42 and the manually turnable actuating structure 30 and 90 constitute together an adjustable weight supporting assembly which cooperates with the two sets of weights 100 to allow a user to selectively connect to the weight supporting assembly a selected number of weights 100 supported on the base 110 while leaving those not selected supported on the base 110.

The shaft 30 includes two opposite connecting ends 32, an intermediate portion 31 between the connecting ends 32, two shoulder portions 33 each defined between the intermediate portion 31 and the corresponding connecting end 32, left- and right-handed threads 34, 35 that are formed on the intermediate portion 31 and that are axially spaced apart from each other, two screw holes 36 formed, respectively, in the connecting ends 32, and two eccentric projections 37 projecting axially, outwardly, and respectively from end faces of the connecting ends 32. The intermediate portion 31 has a diameter larger than those of the connecting ends 32.

The selector tubes 41, 42 are sleeved around and engage threadedly and respectively the left- and right-handed threads 34, 35 of the shaft 30. The selector tube 41 includes inner and outer peripheral faces 411, 412, and a threaded portion 413 (see FIG. 9) formed in the inner face 411 and engageable with the left-handed thread 34 of the shaft 30. The selector tube 42 includes inner and outer faces 421, 422, and a threaded portion 423 formed in the inner face 421 and engageable with the right-handed thread 35 of the shaft 30. Each of the selector tubes 41, 42 further includes two diametrically opposed guide pins 43, 44 projecting outwardly from the outer face 412, 422 of the corresponding tube 41, 42.

The handle 50 is sleeved on the outer faces 412, 422 of the tubes 41, 42, and has two opposite engaging portions 51, in the form of discs 51, at two opposite ends thereof respectively.

The fastening members 60 are sleeved slidably and respectively on the selector tubes 41, 42, and are connected respectively to the engaging portions 51 of the grip rod 50. Each of the first fastening members 60 includes inner and outer faces 61, 62, a central hole 63 extending axially through the inner and outer faces 61, 62, two diametrically opposed notches 64 extending axially through the inner and outer faces 61, 62 and in spatial communication with the central hole 63, four angularly spaced-apart screw holes 65 extending axially through the inner and outer faces 61, 62 and disposed around the central hole 63, and two diametrically opposed screw holes 66 extending axially through the inner and outer faces 61, 62 and aligning with the notches 64.

In assembly, each fastening member 60 is sleeved on the corresponding selector tube 41, 42 via the central hole 63 such that the inner face 61 abuts against the corresponding engaging portion 51 of the handle 50. During this operation, the guide pins 43, 44 of each selector tube 41, 42 extend through the corresponding fastening member 60 via the notches 64. Four bolts 67 are passed respectively through the screw holes 65 so as to engage threadedly the corresponding engaging portion 51 of the handle 50, thereby securing each fastening member 60 to the corresponding engaging portion 51 of the handle 50.

Each of the support units 70 has upper and lower support seats 71 disposed above and below one of the selector tubes 41, 42. The upper and lower support seats 71 of each support unit 70 include inner end faces 72 respectively connected to and facing the outer face 62 of the corresponding first cover 60, outer end faces 73 opposite to the inner end faces 72, intermediate sections 74 interconnecting the inner and outer end faces 72, 73 and provided with a plurality of spaced-apart spacers 76, and guide grooves 75 extending axially from the inner end face 72 to the outer end face 73.

The guide pins 43, 44 of each tube 41, 42 are received slidably and respectively in the guide grooves 75 of the upper and lower support seats 71 of the corresponding support unit 70 so that axial movement of the tubes 41, 42 relative to the shaft 30 is limited, and rotation of the selector tubes 41, 42 relative to the shaft 30 is prevented. It should be noted that when the locations of the guide pins 43, 44 and the guide grooves 75 are interchanged, the same result is achieved.

In this embodiment, five spaced-apart spacers 76 are provided on the intermediate sections 74 of the upper and lower support seats 71 of each support unit 70 for supporting four pieces of weights 100. The distance between two adjacent ones of the spacers 76 is equal to one pitch of the left- and right-handed threads 34, 35 of the shaft 30. Thus, when the shaft 30 is turned one revolution, i.e., 360°, the selector tubes 41, 42 move simultaneously in opposite directions one pitch towards or away the connecting ends 32 of the shaft 30.

During assembly, after the inner end faces 72 of the upper and lower support seats 71 of each support unit 70 are caused to abut against the outer face 62 of the corresponding fastening member 60, two bolts 77 are passed respectively through the screw holes 66 so as to engage threadedly and respectively the inner end faces 72 of the upper and lower support seats 71, thereby fastening each support unit 70 to the corresponding fastening member 60.

With reference to FIGS. 6, 7, 8, and 10, the adjustment knob units 90 are respectively connected to the connecting ends 32 of the shaft 30 to allow the user to turn the shaft 30 relative to the handle 50 and to thereby move the selector tubes 41, 42 axially of the shaft 30 in opposite directions towards or away from the connecting ends 32 of the shaft 30. Each of the adjustment knob units 90 includes a second cover or outer fastening member 80 and a cap 91. The outer fastening member 80 is sleeved on one of the connecting ends 32 of the shaft 30, and includes opposite inner and outer faces 81, 82, an outer peripheral face 83 interconnecting the inner and outer faces 81, 82, two diametrically opposed cutout portions 84 (see FIG. 7) formed in the inner face 81 for receiving respectively the outer end faces 73 of the upper and lower support seats 71 of the corresponding support unit 70, a through hole 85 extending axially through the inner and outer faces 81, 82 and disposed between the cutout portions 84 for insertion of the corresponding connecting end 32 of the shaft 30 therethrough, two diametrically opposed screw holes 86 extending axially through the inner and outer faces 81, 82 and communicating with the respective cutout portions 84, and a positioning hole 87 formed in the outer face 82 and radially offset from the shaft 30.

After the outer fastening member 80 of each adjustment knob unit 90 is sleeved on the corresponding connecting end 32 of the shaft 30 via the through hole 85 until the inner face 81 abuts against the outer end faces 73 of the upper and lower support seats 71 of the corresponding support unit 70 and the corresponding shoulder portion 33 of the shaft 30, two bolts 88 are passed respectively through the screw holes 86 so as to engage threadedly and respectively the outer end faces 73 of the upper and lower support seats 71 of the corresponding support unit 70, thereby fastening the outer fastening member 80 to the upper and lower support seats 71 of the corresponding support unit 70.

The cap 91 is sleeved rotatably on the outer fastening member 80, and includes a plate section 912, an annular sleeve 913 that extends axially, inwardly, and integrally from an outer periphery of the plate section 912 and that is sleeved on the outer peripheral face 83 of the outer fastening member 80, a tubular protrusion 914 projecting axially and inwardly from the center of the plate section 912, an eccentric socket 915 projecting axially and inwardly from the plate section 912, a central hole 916 formed in the plate section 912 and communicating with the tubular protrusion 914, and a slot 917 formed in the tubular protrusion 914 adjacent to the through hole 916 for receiving the corresponding eccentric projection 37 of the shaft 30.

The cap 91 further includes a spring-loaded detent which has a compression spring 92 disposed in the socket 915, and a roller 93 biased by the spring 92 to engage resiliently the positioning hole 87. The roller 93 has a diameter larger than that of the positioning hole 87 so that the roller 93 can be easily removed from the positioning hole 87.

After the cap 91 is sleeved on the outer fastening member 80, a bolt 94 is passed through the central hole 916 to engage the screw hole 36 in the corresponding connecting end 32 of the shaft 30, so that the cap 91 and the outer fastening member 80 are secured to the shaft 30.

It should be noted that when one of the projections 37 of the shaft 30 is inserted into the slot 917 in the cap 91, the roller 93 projects into the positioning hole 87 so as to enhance alignment and assembly.

There are four of the weights 100 in each set thereof. Each of the weights 100 includes a straddling hole that has an engaging hole section 101 engageable with the corresponding selector tube 41, 42, a long hole section 103 extending radially and outwardly from the engaging hole section 101 and through an outer peripheral face 102 of the weight 100, and a short hole section 104 extending radially and outwardly from the engaging hole section 101 opposite to the long hole section 103. Each of the long and short hole sections 103, 104 constitute a radial opening or hole which extends from a central area of each weight 100 to a peripheral area thereof and has a width smaller than a width of the engaging hole section 101. The engaging hole section 101 constitutes at least one and preferably two opposed transversely extending openings or holes which communicate with the radial opening or hole defined by the hole sections 103, 104. Through the presence of the long and short hole sections 103, 104, each set of the weights 100 can be straddled on the upper and lower support seats 71 of one of the support units 70. At this time, the weights 100 in each set are spaced apart from each other by the spacers 76. Each of the weights 100 is prevented from moving axially by two adjacent ones of the spacers 76 of the upper and lower support seats 71. Each of the selector tubes 41, 42 is movable between the upper and lower seats 71 of one of the support units 70 enabling the cylindrical exterior surface thereof to selectively engage the surfaces defining one or more of the engaging hole sections 101 of the weights 100.

The base 110 (see FIG. 5) includes a plurality of spaced-apart retainers 112 projecting upwardly and integrally from a top face 111 thereof. The distance between two adjacent ones of the retainers 112 is equal to the distance between two adjacent ones of the spacers 76. Each two adjacent ones of the retainers 112 cooperate with the top face 111 to define a receiving space 113 for receiving a corresponding one of the weights 100.

Figure 8:
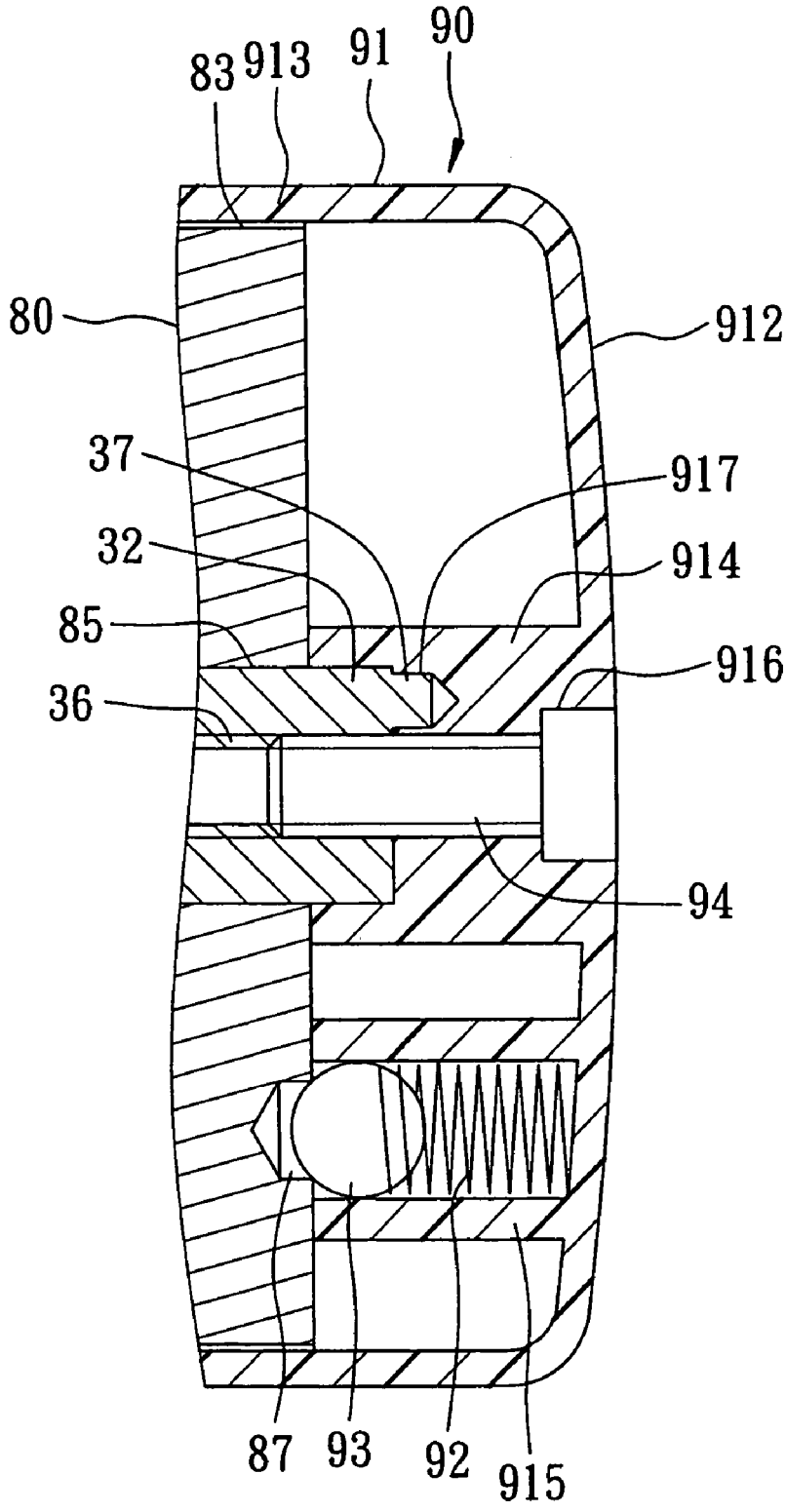
FIG. 8 is a fragmentary sectional view of the adjustment knob unit of the first embodiment in an assembled state.
Figure 9:
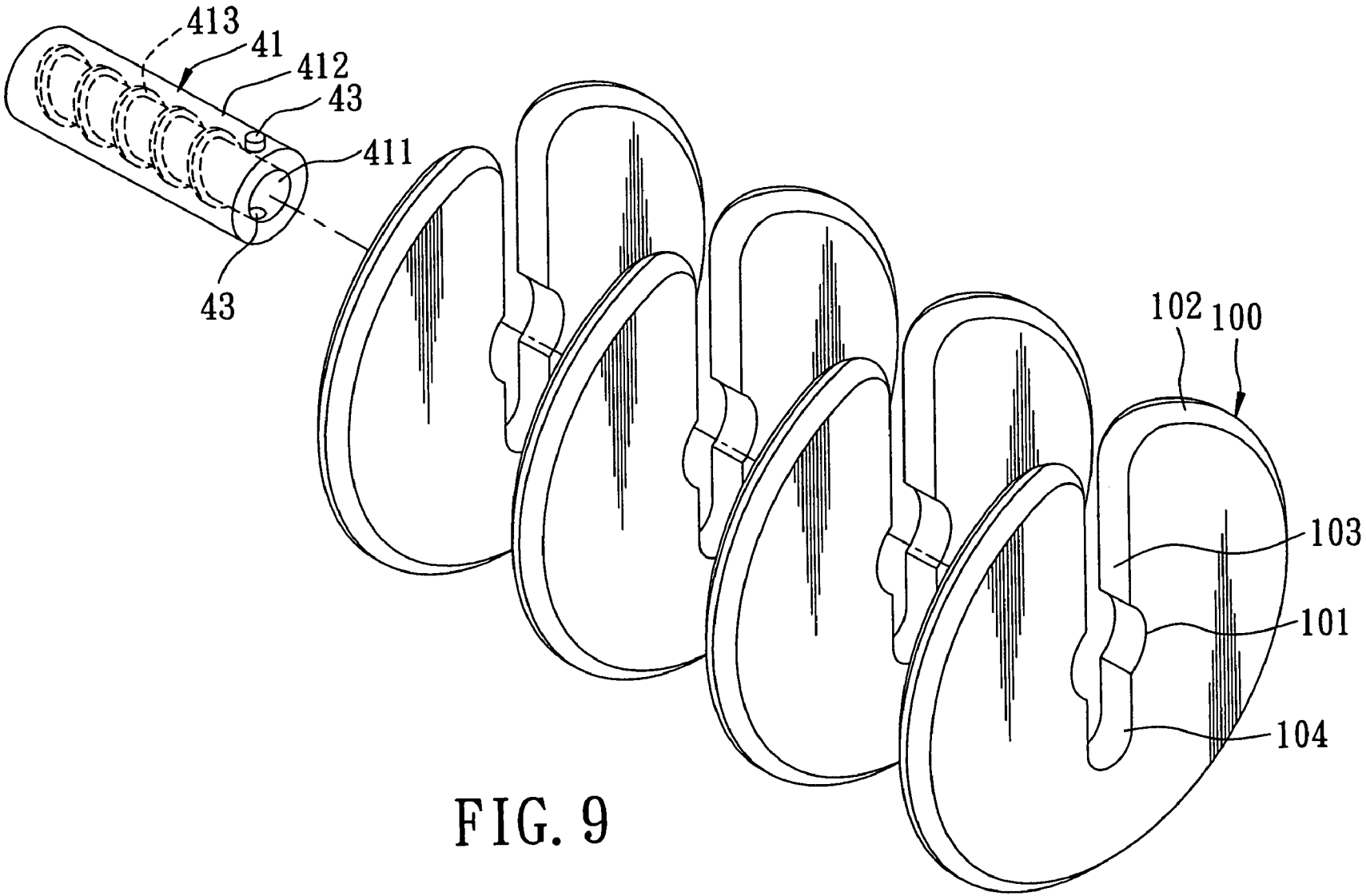
FIG. 9 is a partly exploded perspective view of the first embodiment, illustrating how a tube can engage engaging hole sections of a plurality of weights.

Each weight 100 is typically received in the corresponding receiving space 113 in the base 110 with the long hole section 103 facing upwardly, and the roller 93 is projected into the positioning hole 87 (see FIG. 8). When the user desires to adjust the weight of the dumbbell of the present invention, he/she simply rotates the cap 91 of one of the adjustment knob units 90.

Figure 10:
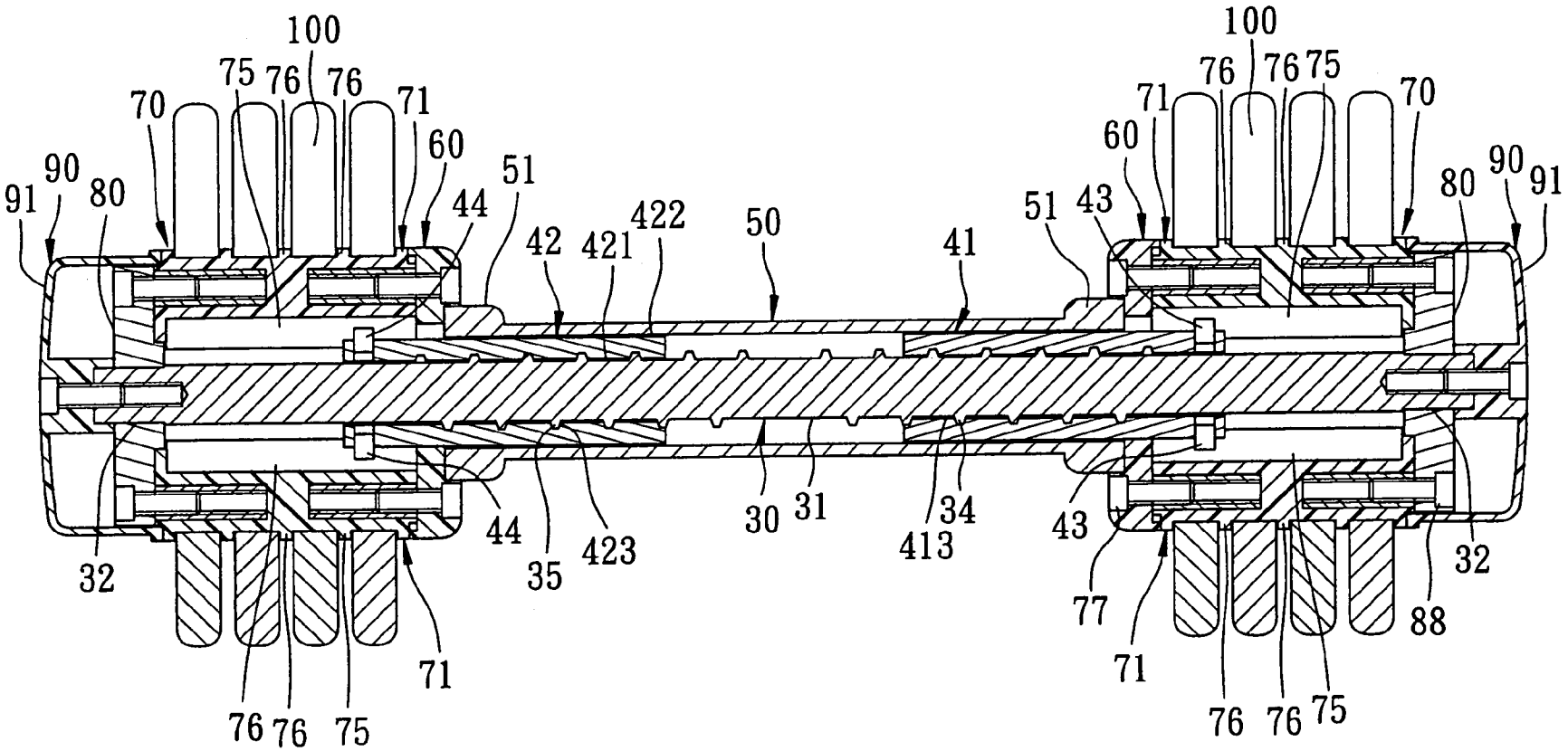
FIG. 10 is a sectional view of the first embodiment in an assembled state.

Referring to FIG. 10, if each selector tube 41, 42 is engaged to the engaging hole section 101 of only one of the weights 100 in each set, when the user grasps and lifts the handle 50 of the dumbbell, only one of the weights 100 in each set is carried away by the corresponding support unit 70. The rest of the weights 100 remain on the base 110.

Figure 11:
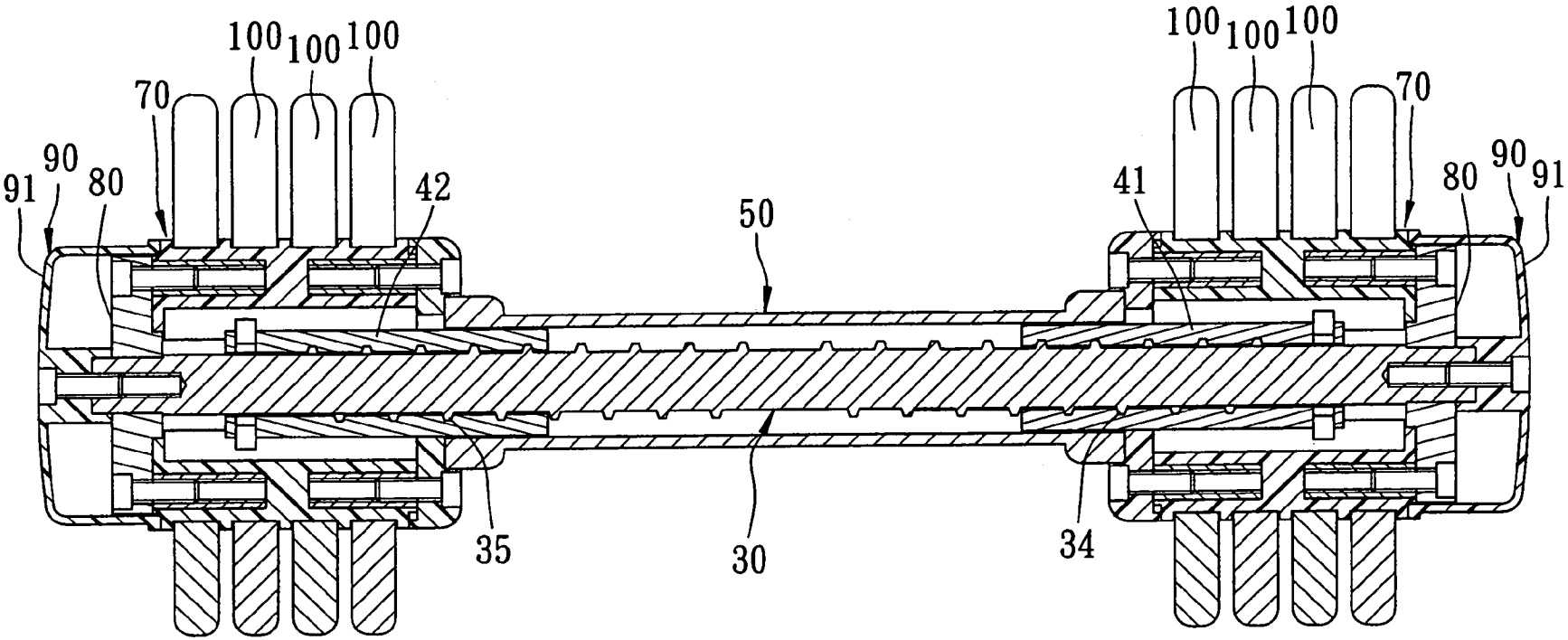
FIG. 11 is a view similar to FIG. 10, but with two tubes in another position.
Figure 12:
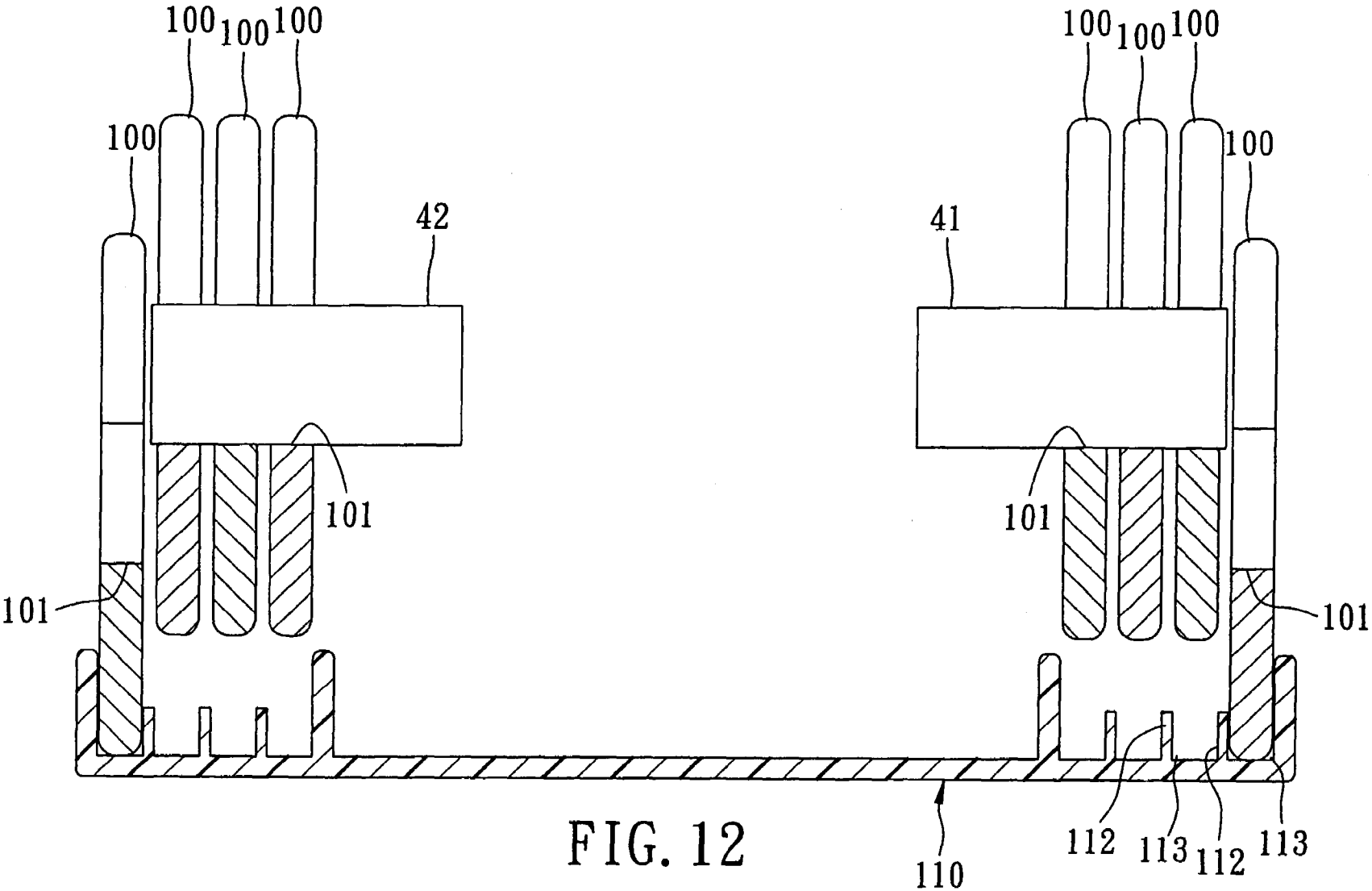
FIG. 12 is a sectional front view of the first embodiment, illustrating each tube supporting three weights.

Referring to FIGS. 11 and 12, in combination with FIG. 10, to increase the number of the weights 100 on each side of the dumbbell of the present invention, the cap 91 of one of the adjustment knob units 90 is rotated in a clockwise direction. As an example, the cap 91 of one of the adjustment knob units 90 may be rotated clockwise two turns, so as to similarly rotate the shaft 30 two turns in the clockwise direction. This will result in each selector tube 41, 42 moving simultaneously two pitches toward the respective connecting ends 32 of the shaft 30 and thereby engaging the engaging hole sections 101 of three of the weights 100 in each set. Hence, when the user grasps and lifts the handle 50 of the dumbbell of the present invention, three of the weights 100 in each set are carried away by the corresponding support unit 70, while the other weights 100 are left remaining on the base 110.

Figure 13:
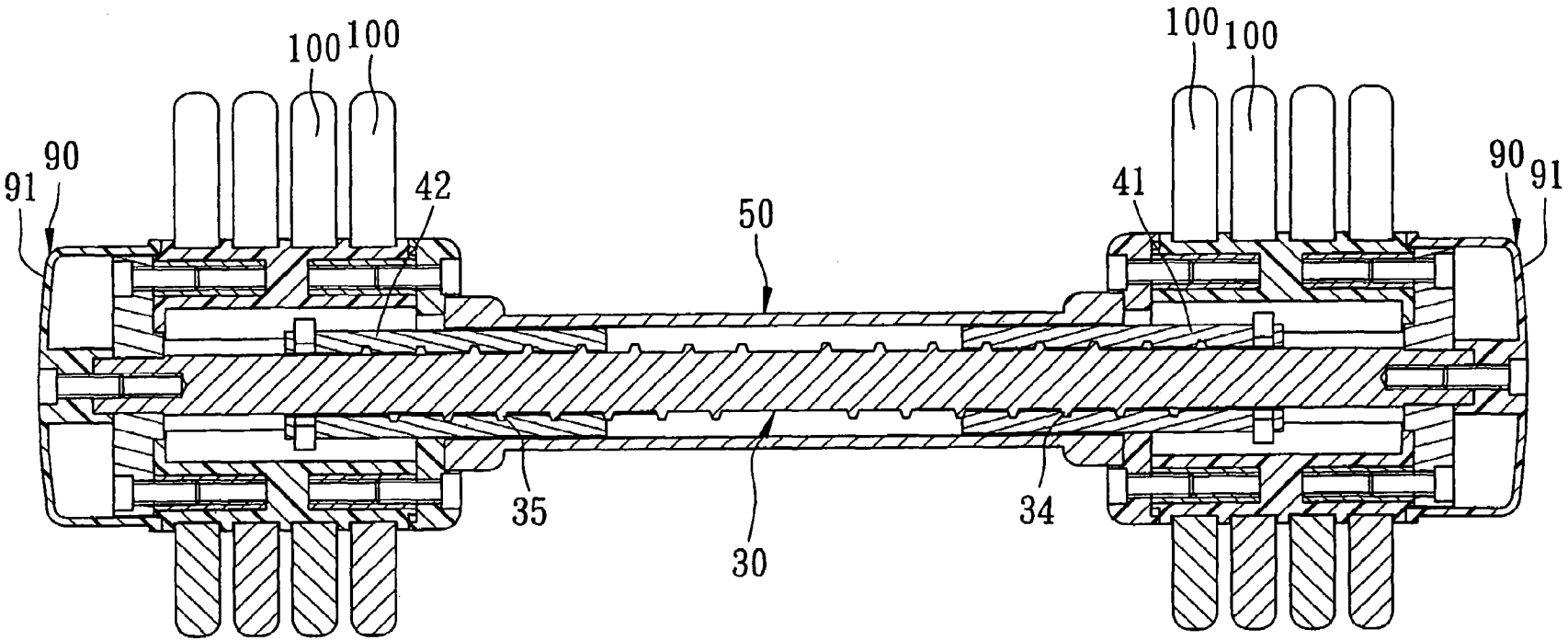
FIG. 13 is a view similar to FIG. 10, but with the tubes in still another position.
Figure 14:
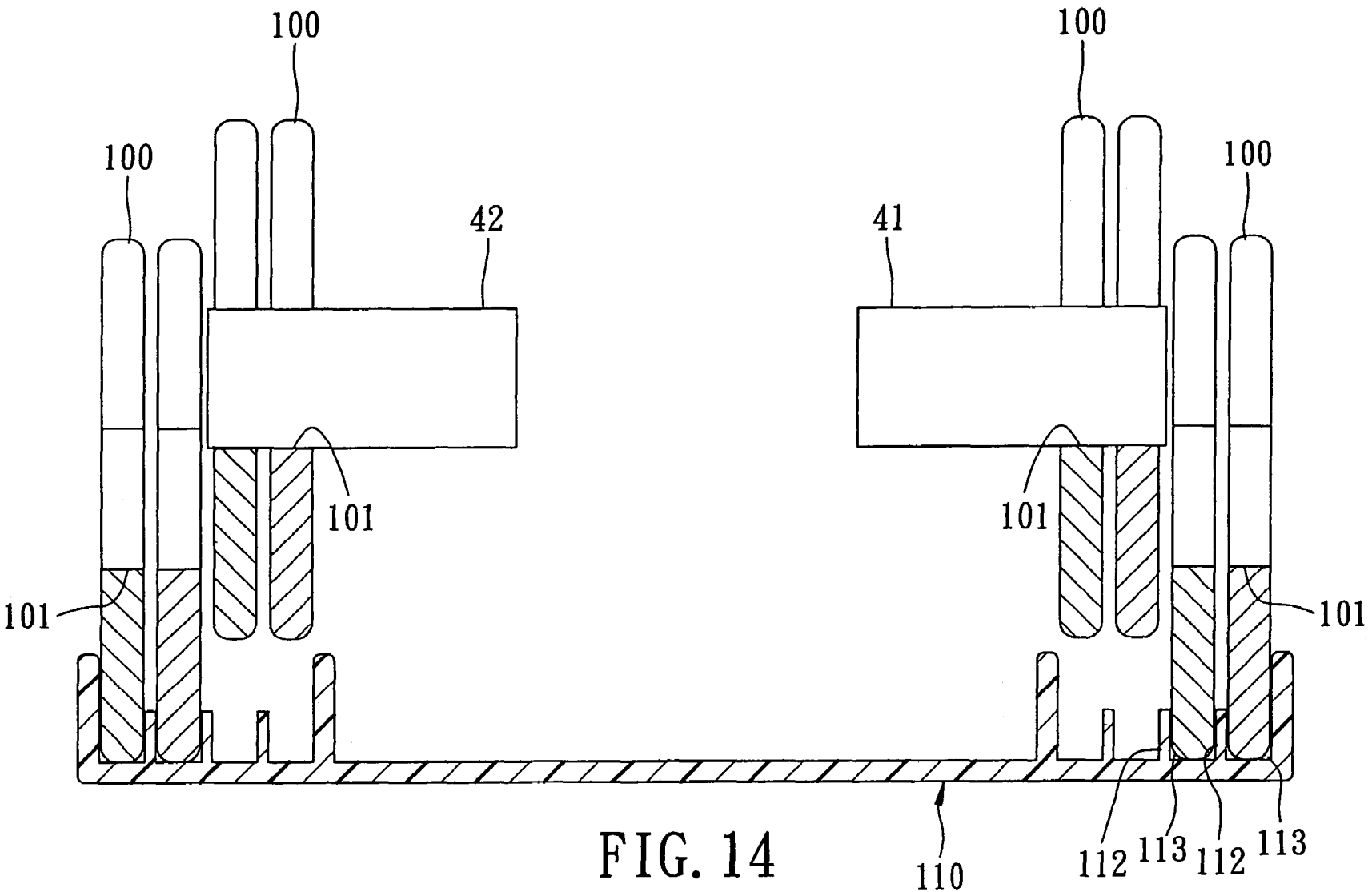
FIG. 14 is a view similar to FIG. 12, but with each tube supporting two weights.
Figure 15:
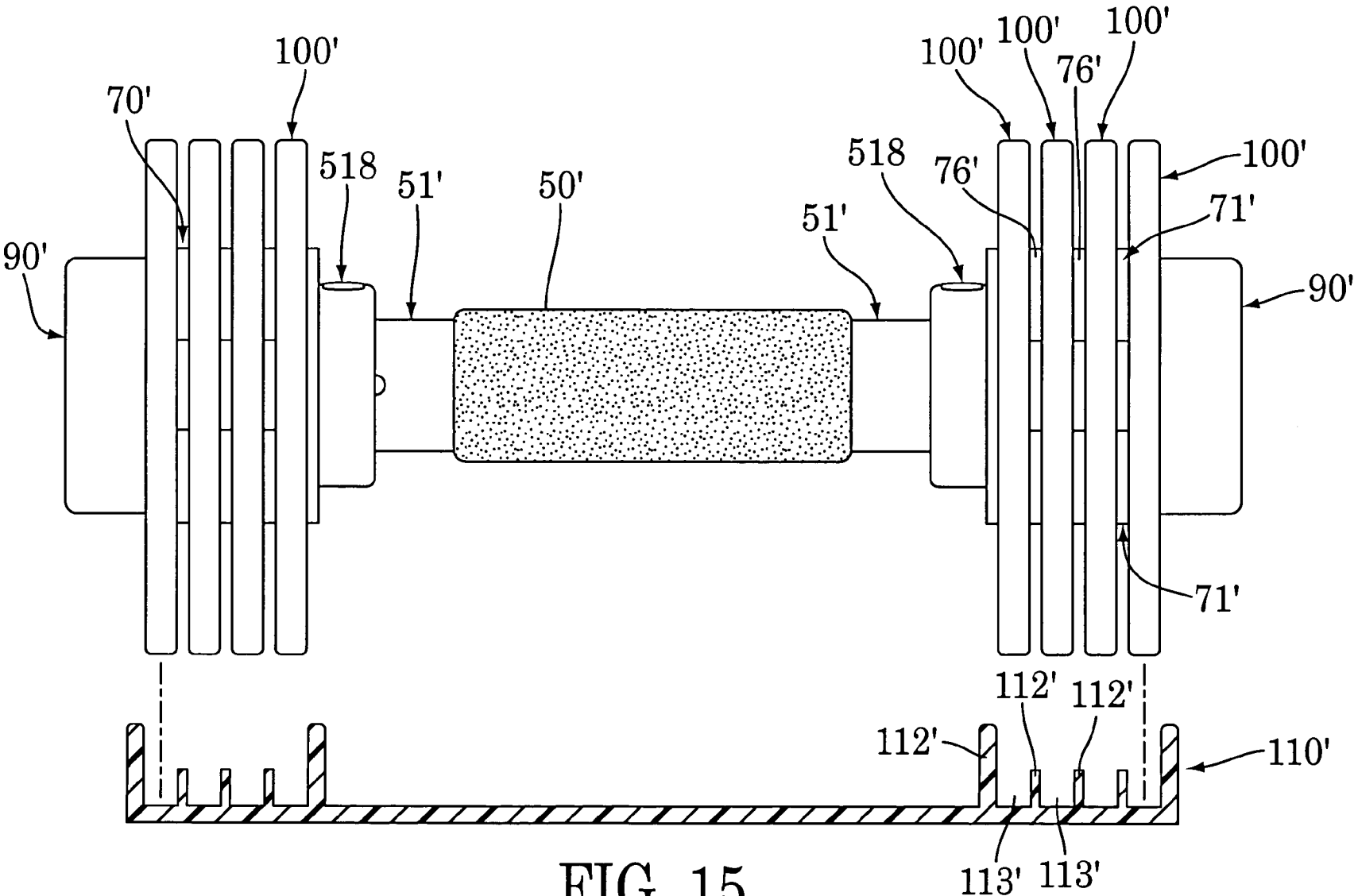
FIG. 15 is a schematic partly sectional side view of a second embodiment of an adjustable dumbbell embodying the principles of the present invention.

Referring to FIGS. 13 and 14, in combination with FIG. 11, to reduce the number of weights 100 on each side of the dumbbell of the present invention, the cap 91 of one of the adjustment knob units 90 is rotated in a counterclockwise direction. For example, if the cap 91 of one of the adjustment knob units 90 is rotated by one turn, the shaft 30 is similarly rotated one turn also in the counterclockwise direction. This will result in each selector tube 41, 42 moving simultaneously one pitch toward the handle 50 and away from the respective connecting ends 32 of the shaft 30, thereby engaging the engaging hole sections 101 of two of the weights 100 in each set. Hence, when the user grasps and lifts the handle 50 of the dumbbell of the present invention, only two of the weights 100 in each set are carried away by the corresponding support unit 70, while the other weights 100 are left remaining on the base 110.

It should be noted that during rotation of the cap 91, the roller 93 is moved away from the positioning hole 87, and abuts against the outer face 82 of the second cover 80, thereby compressing the spring 92. After the cap 91 has turned one revolution, the roller 93 is pushed by the restoring force of the spring 92 to extend back into the positioning hole 87. This returning of the roller 93 back into the positioning hole 87 may be perceived by the user to thereby let the user know that the cap 91 has turned one revolution, and the number of the weights 100 on each side of the dumbbell of the present invention has been reduced or increased by one.

From the aforementioned description, the advantages of the adjustable dumbbell of the present invention may be summarized as follows:

1. Rotation of the cap 91 of one of the adjustment knob units 90 can permit each selector tube 41, 42 to move toward or away from the corresponding connecting end 32 of the shaft 30 so as to selectively engage one or more of the engaging hole sections 101 of the weights 100. Hence, the weight on each side of the dumbbell of the present invention can be adjusted easily and quickly.

2. Through coordination of the positioning hole 87 in the outer fastening member 80 and the spring-loaded detent of the cap 91, the user is able to sensually perceive the number of turns the cap 91 has rotated and therefore the number of the weights 100 supported by each support unit 70.

Referring now more particularly to FIGS. 15-24, there is shown therein a second embodiment of an adjustable dumbbell having an adjustable weight supporting assembly similar to the weight supporting assembly previously described in which similar parts are designated by the same number with an added prime. As before, the weight supporting assembly operates with the two sets of weights 100' to allow a user to selectively connect a selected number of weights 100' supported on the base or mounting seat 110' while leaving those not selected supported on the base 110'. The weights 100' and base 110' are constructed exactly in accordance with the weights 100 and base 110 previously described and hence no detailed description of the weights 100' and base 110' is believed necessary.

The adjustable weight supporting assembly does differ but includes the basics as before: (1) a fixed weight supporting structure including a central handle 50', two first covers or fastening members 60' and two support units or limiting member seats 70' for supporting the two sets of weights 100' on opposite sides of the handle 50', (2) a weight selector structure or weight carrier in the form of two selector tubes 41' and 42', and (3) a manually turnable actuating structure in the form of two adjustment knob units or operating caps 90' and two shafts or screw rods 30'.

The provision of two shafts 30' rather than the single shaft 30 of the first embodiment constitutes a first of two differences between the two embodiments. The first difference translates into a difference in operation. In the first embodiment, either one of the two adjustment knobs 90 could be used to simultaneously move both movable selector tubes 41 and 42, whereas in the second embodiment, one of the two adjustment knob units 90' must be used to move the movable selector tubes 41' or 42' threadedly connected thereto, while the other one of the two adjustment knob units 90' must be used to move the other of the movable selector tubes 41' or 42'.

Figure 16:
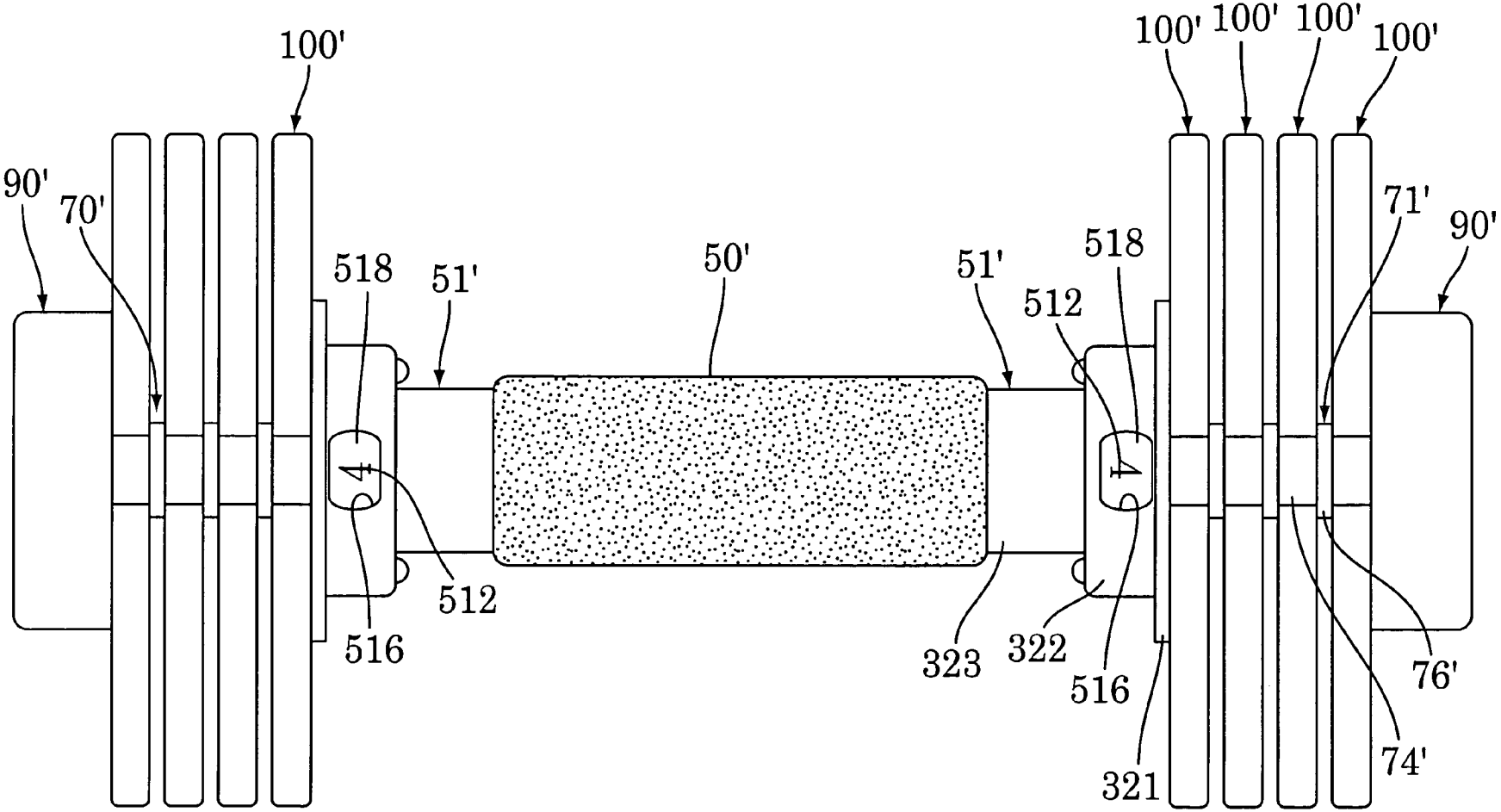
FIG. 16 is a top plan view of the second embodiment.
Figure 17:
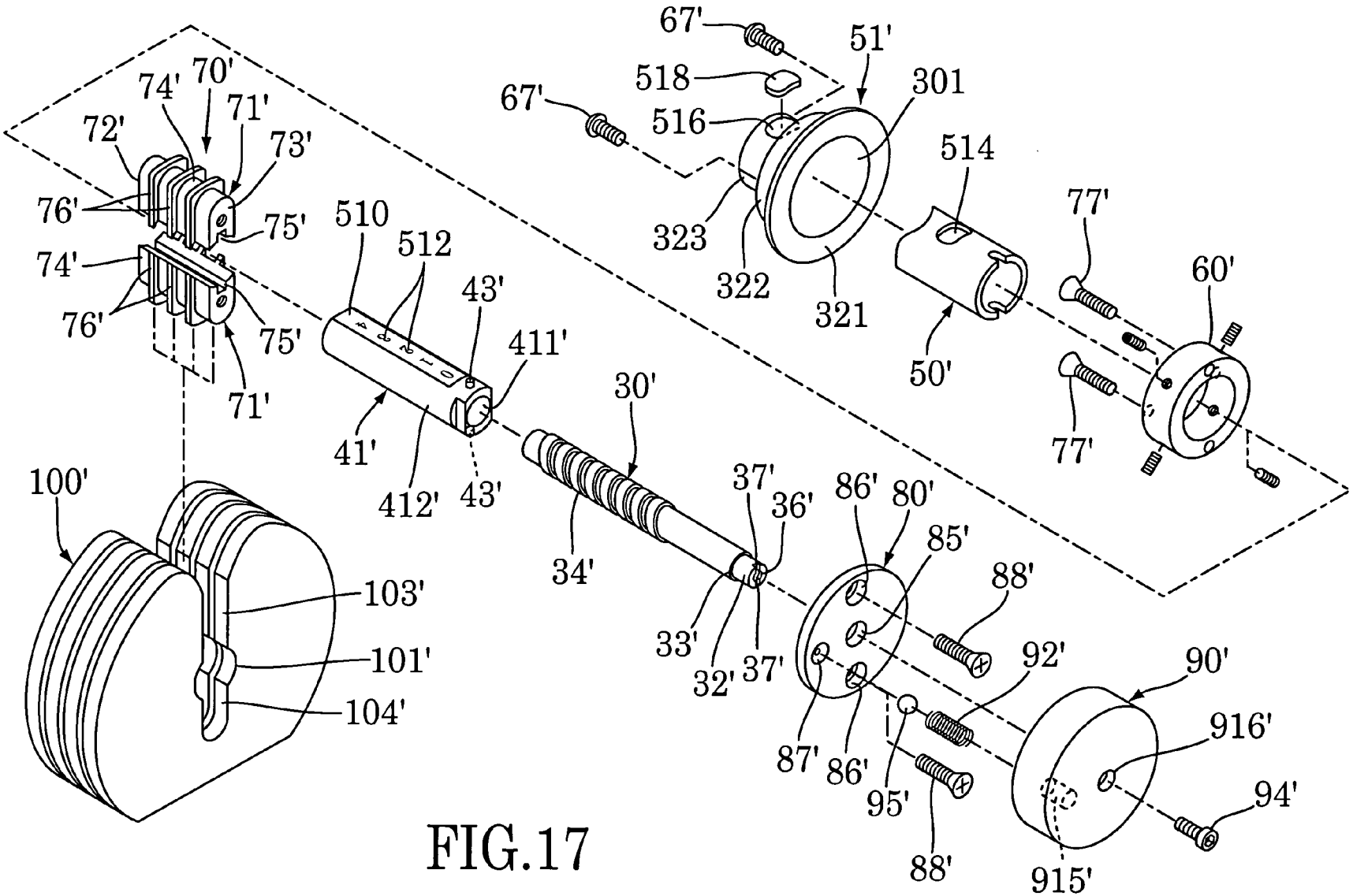
FIG. 17 is an exploded perspective view of the second embodiment.

The second difference is a selector viewing feature which is included in the second embodiment which is not present in the first embodiment, but could readily be embodied in the first embodiment. As best shown in FIGS. 16 and 17, each movable selector tubes 41' and 42' includes an upwardly facing planar surface 510 having weight scale marks or indicia 512 thereon corresponding to the numbers and values of the weights 100'. The hollow handle 50' has an upwardly facing window opening 514 at each end thereof and the engaging portions 51' fixed at each end of the handle 50' have aligned window openings 516 therein. Preferably, a sight glass 518 is mounted in each window opening 516.

As best shown in FIG. 16, the sight glass 518 at each end of the handle 50' is easily viewed by the user from above when the adjustable weight supporting assembly has been moved into cooperating relation with the two sets of weights 100' supported in operative positions on the base 110'. The user can readily reach down and turn the adjustment knob unit 90' on each side of the adjustable weight supporting assembly while viewing the associated sight glass 518. to determine the number and combined value of the weights connected to each side. It will be understood that the structure of this viewing feature could be readily incorporated in the first embodiment.

Except for the two differences included in the second embodiment discussed above, the second embodiment includes most of the structure included in the first embodiment and operates the same except for the operational difference noted.

Each shaft or screw 30' includes a connecting end 32', having a shoulder portion 33' and exterior right-handed threads 34'. A screw hole 36' is formed in the connecting end 32' and two aligned radial slots 37' are formed in the extremity of the connecting end 32'.

Figure 21:
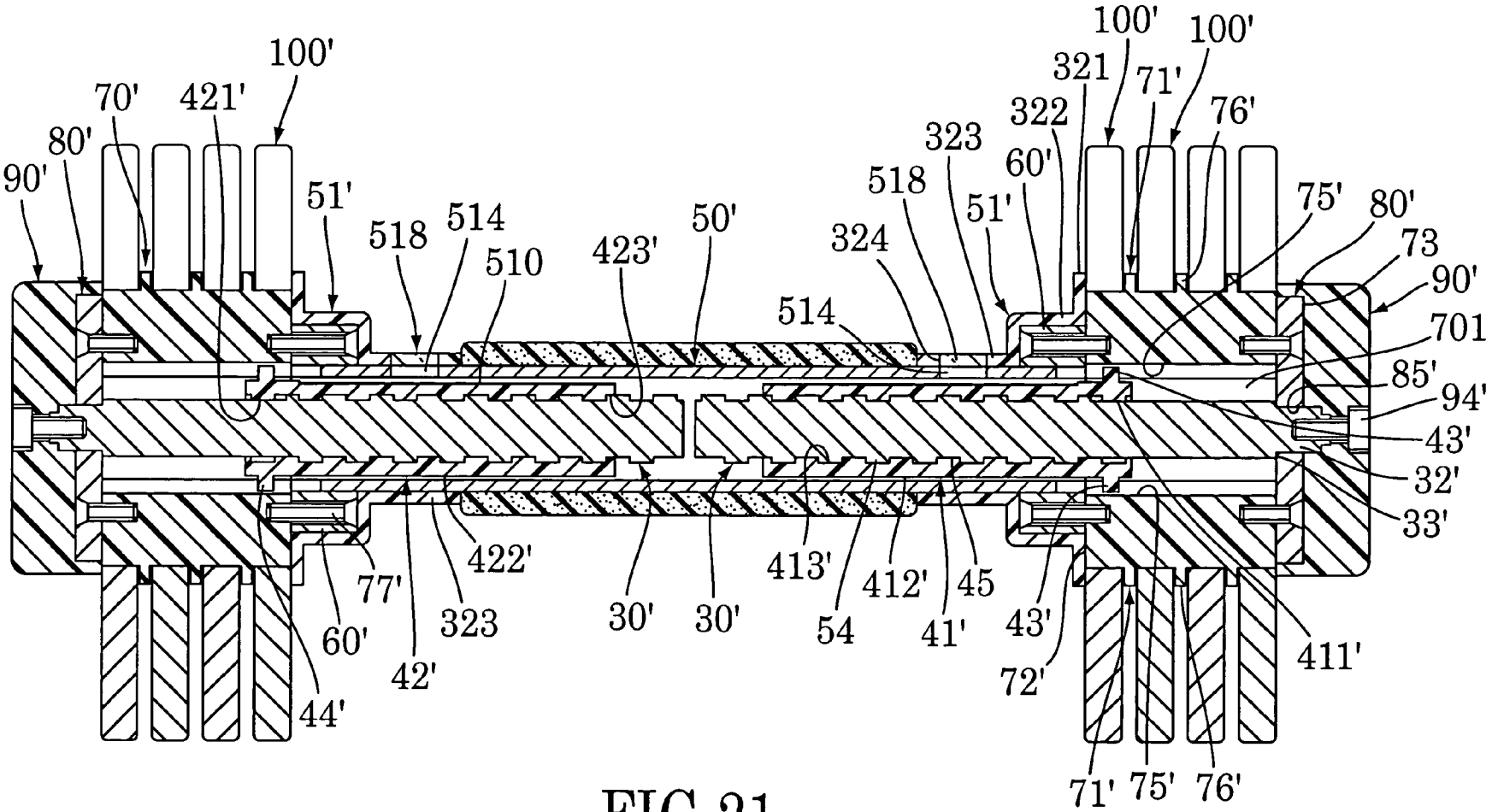
FIG. 21 is a sectional view to illustrate the adjustable dumbbell of the second embodiment wherein the weight selector structure is moved to a position for supporting one of a plurality of weights of the second embodiment.
Figure 22:
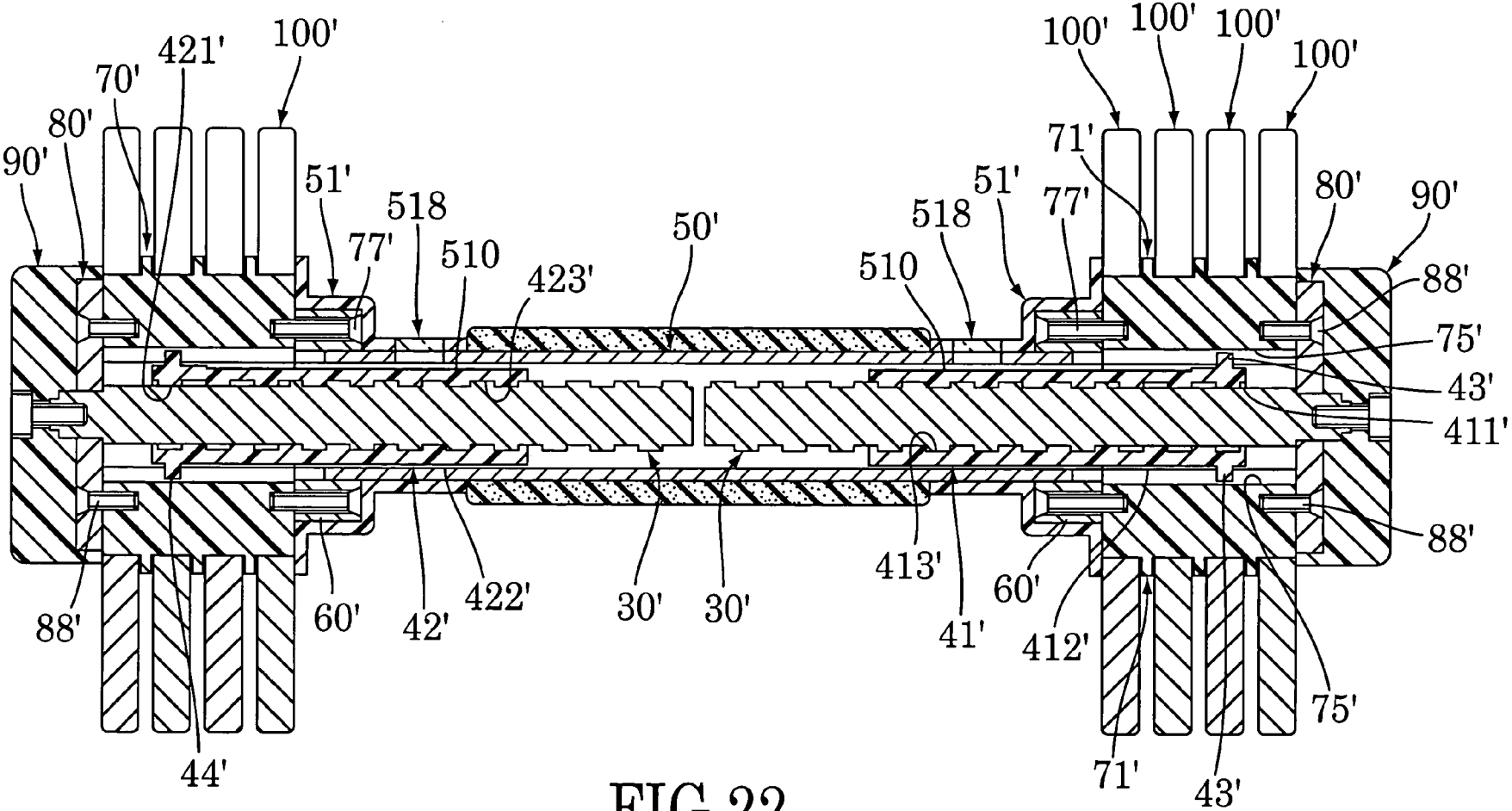
FIG. 22 is a sectional view to illustrate another condition of the adjustable dumbbell wherein the weight selector structure is moved to another position for supporting three of the weights of the second embodiment.
Figure 23:
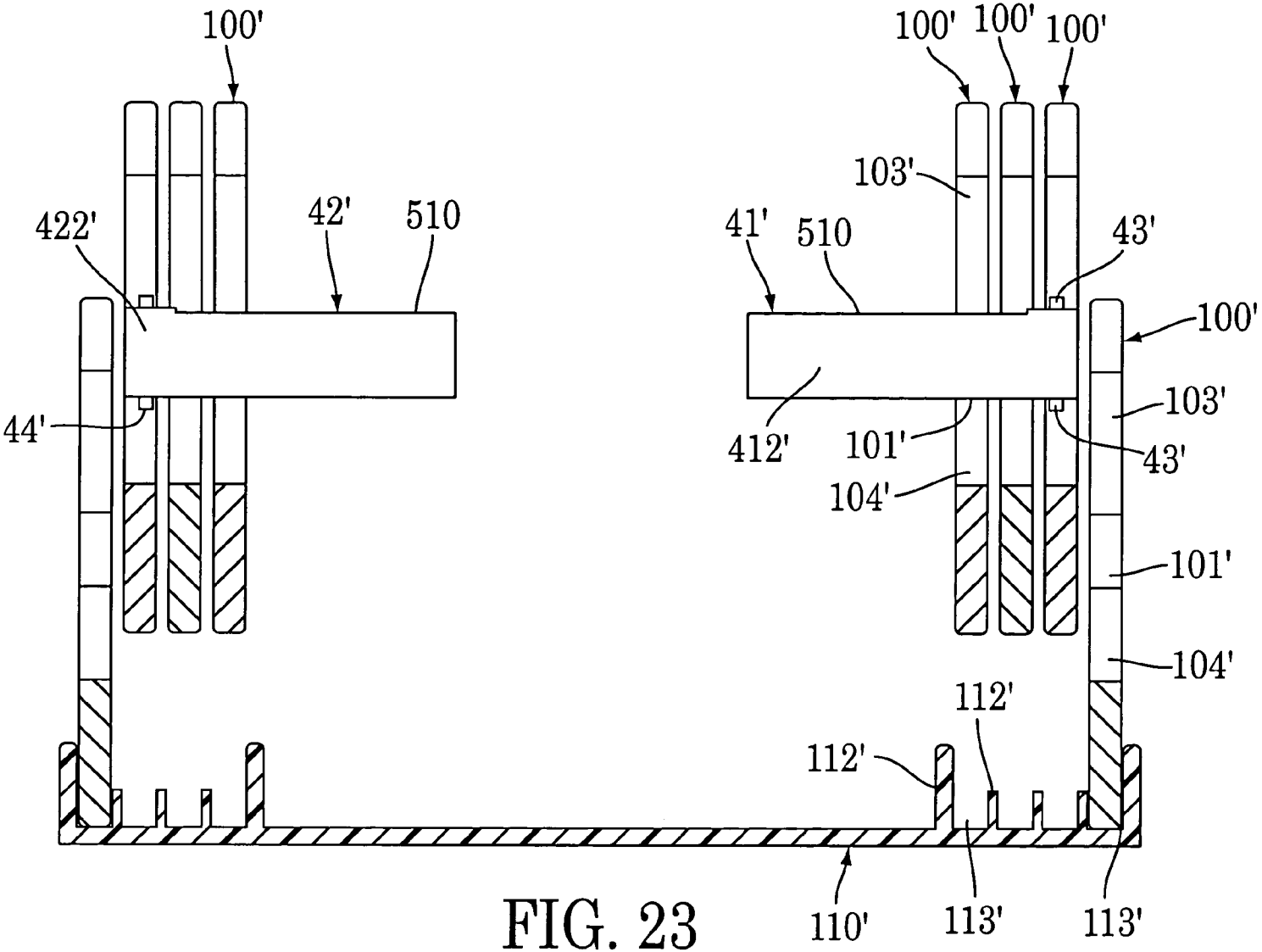
FIG. 23 is a sectional view to illustrate a condition of the adjustable dumbbell wherein the weight selector structure lifts three of the weights from a mounting seat base or of the second embodiment.
Figure 24:
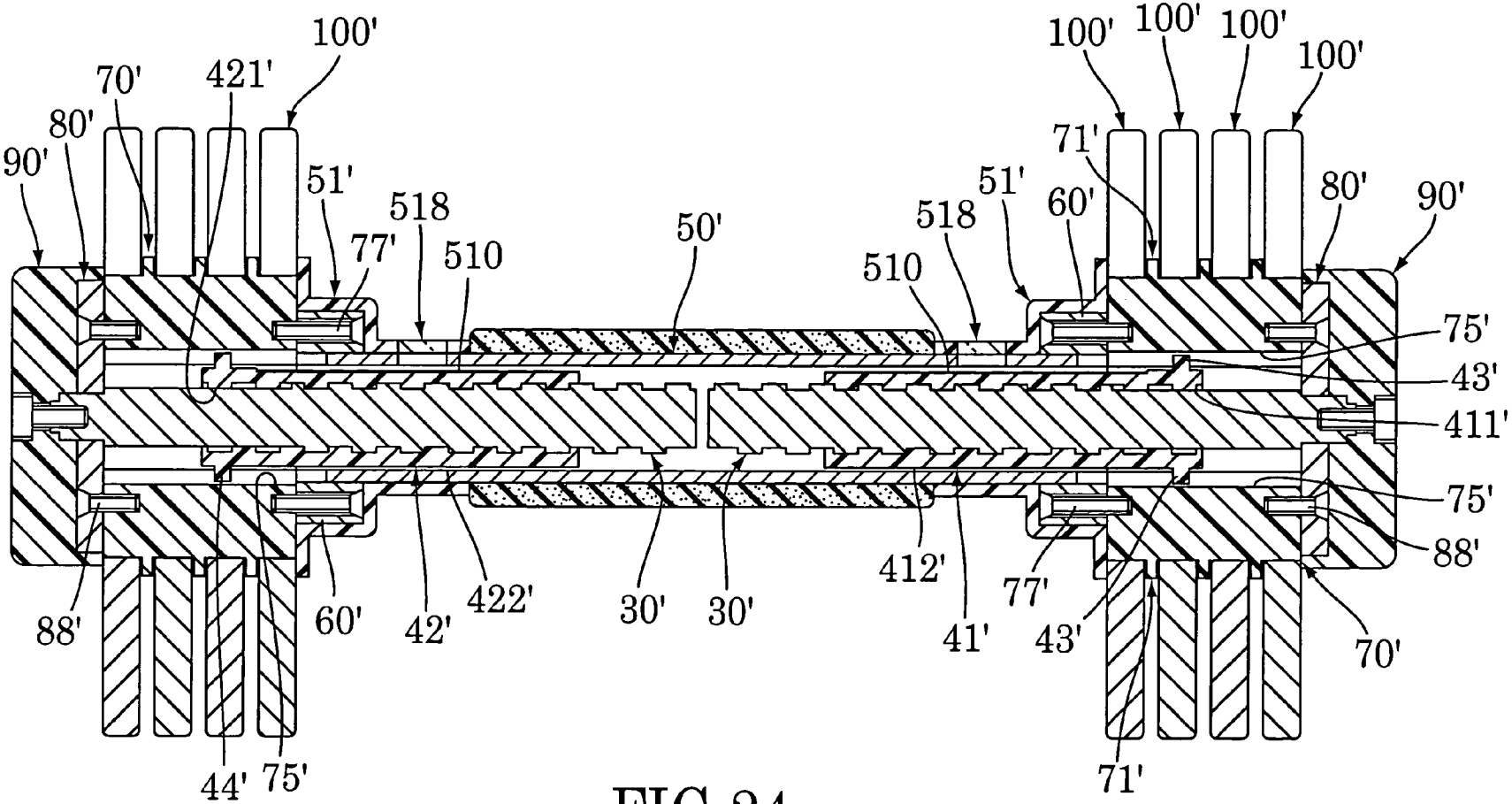
FIG. 24 is a sectional view to illustrate yet another condition of the adjustable dumbbell wherein the weight selector structure is moved to yet another position for carrying two of the weights of the second embodiment.
Figure 25:
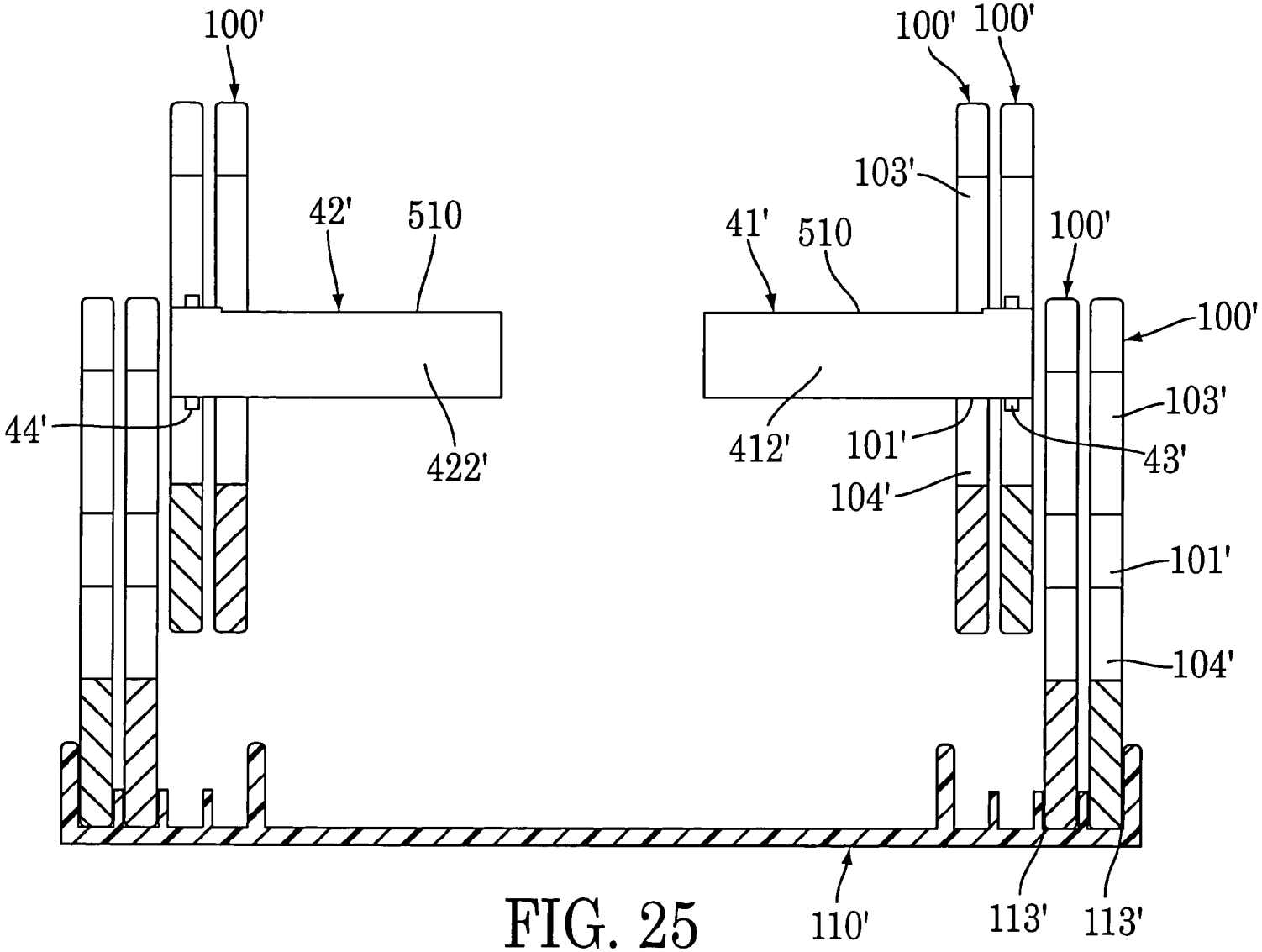
FIG. 25 is a sectional view to illustrate another condition of the adjustable dumbbell wherein the weight selector structure lifts two of the weights from the mounting base or seat of the second embodiment.

The selector tubes 41', 42' are sleeved around and engage threadedly with the right-handed threads 34' of one of the screw rods 30'. The selector tube 41' includes inner and outer peripheral surfaces 411', 412', and a threaded portion 413' (see FIG. 20) formed in the inner face 411' and engageable with the right-handed thread 34' of one of the screw rods 30'. As best shown in FIGS. 21, 22 and 24, the selector tube 42' includes inner and outer faces 421', 422', and a threaded portion 423' formed in the inner face 421' and engageable with the right-handed thread 34' of the other of the screw rods 30'. The selector tubes 41', 42' further include two diametrically opposed guide pins 43', 44' respectively projecting outwardly from the outer face thereof.

The handle 50' is sleeved on the outer faces 412', 422' of the selector tubes 41', 42', and has two opposite engaging portions in the form of sleeves 51' at two opposite ends thereof, respectively. The engaging portions 51' include tubular inner sections 323 fixed to the outer periphery of the handle 50' inwardly of the ends thereof and outwardly flaring outer tubular sections 322 spaced radially from the outer periphery of the handle 50' at the ends thereof.

Each first cover or fastening member 60' is in the form of a cylindrical ring which fits within the radial space between the inner periphery 301 of the outwardly flaring section 322 of the adjacent engaging portion 51' and the outer periphery of the adjacent end of handle 50'. Each fastening ring 60' is secured to the associated end of the handle 50' by any means, such as, annularly spaced bolts 67' (see FIG. 17), extending through the engaging portion 51' and threadedly engaged into the associated fastening ring 60'.

As best shown in FIG. 17, each fastening ring 60' is fixed to a pair of axially extending radially spaced support units 70' by any suitable means, such as bolts 77'. It is within the contemplation of the present invention that the sleeve engaging portion 51', the fastening member 60', and pair of supporting units 70', could be integrated into a single piece.

Each of the support units 70' has upper and lower support seats 71' disposed above and below one of the selector tubes 41', 42'. The upper and lower support seats 71' of each support unit 70' include inner end faces 72', respectively, connected to and facing the outer face of the corresponding inner fastening member 60', outer end faces 73' opposite to the inner end faces 72', intermediate sections 74' interconnecting the inner and outer end faces 72', 73' and provided with a plurality of spaced-apart spacers 76', and guide grooves 75' extending axially from the inner end face 72' to the outer end face 73'.

The guide pins 43', 44' of each selector tube 41', 42' are received slidably and respectively in the guide grooves 75' of the upper and lower support seats 71' of the corresponding support unit 70' so that axial movement of the selector tubes 41', 42' relative to the screw rod 30' is limited, and rotation of the selector tubes 41', 42' relative to the screw rod 30' is prevented. It should be noted that when the locations of the guide pins 43', 44' and the guide grooves 75' are interchanged, the same result is achieved.

In this embodiment, three spaced-apart spacers 76' are provided on the intermediate sections 74' of the upper and lower support seats 71' of each support unit 70' for supporting four pieces of weights 100'. The distance between two adjacent ones of the spacers 76' is equal to one pitch of the right-handed threads 34', of each shaft 30'. Thus, when either shaft 30' is turned one revolution, i.e., 360°, the corresponding selector tube 41' or 42' moves in a corresponding direction one pitch towards or away from the connecting end 32' of the shaft 30'.

With reference to FIGS. 20, 21, 22, and 24, an adjustment knob unit 90' is respectively connected to the connecting end 32' of each shaft 30' to allow the user to turn the shaft 30' relative to the handle 50' and to thereby move the selector tube 41' or 42' axially of the shaft 30' in opposite directions towards or away from the connecting end 32' of the shaft 30'. Each of the adjustment knob units 90' includes a second cover or outer fastening member 80' and a cap 91'.

Each outer fastening member 80' is in the form of a disk having a central opening 85' which allows the disk member 80' to be sleeved on the connecting end 32' of shaft 30'. The inner face of each disk member 80' is disposed in abutting relation to the corresponding support unit 70'. Two diametrically opposed holes 86' extend axially through each disk member 80' and bolts 88' extend through holes 86' into threaded relation to the upper and lower seats 71' of the associated support unit 70'.

Figure 18:
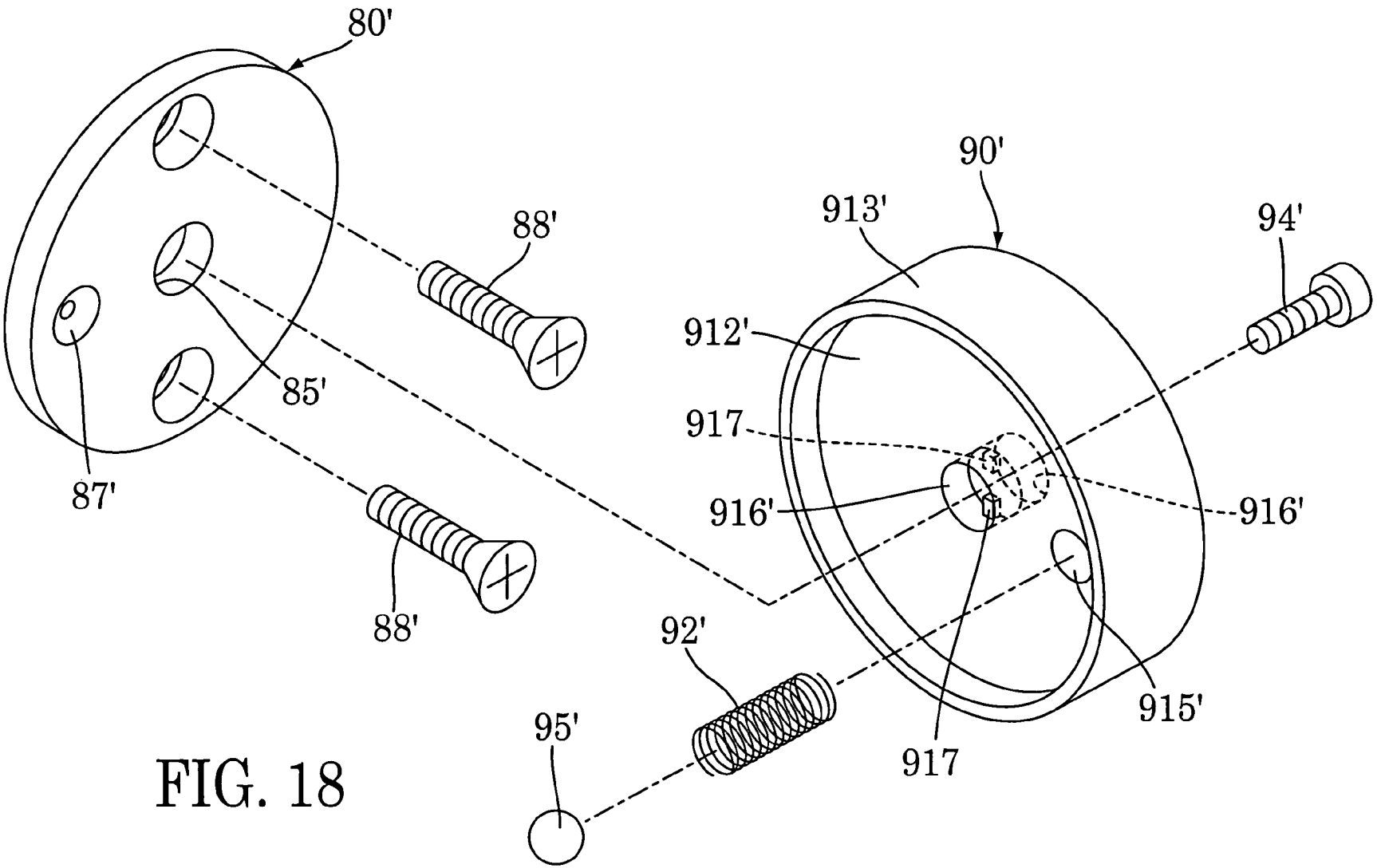
FIG. 18 is an exploded perspective view to illustrate the configuration of a turn-indicating unit of the second embodiment.
Figure 19:
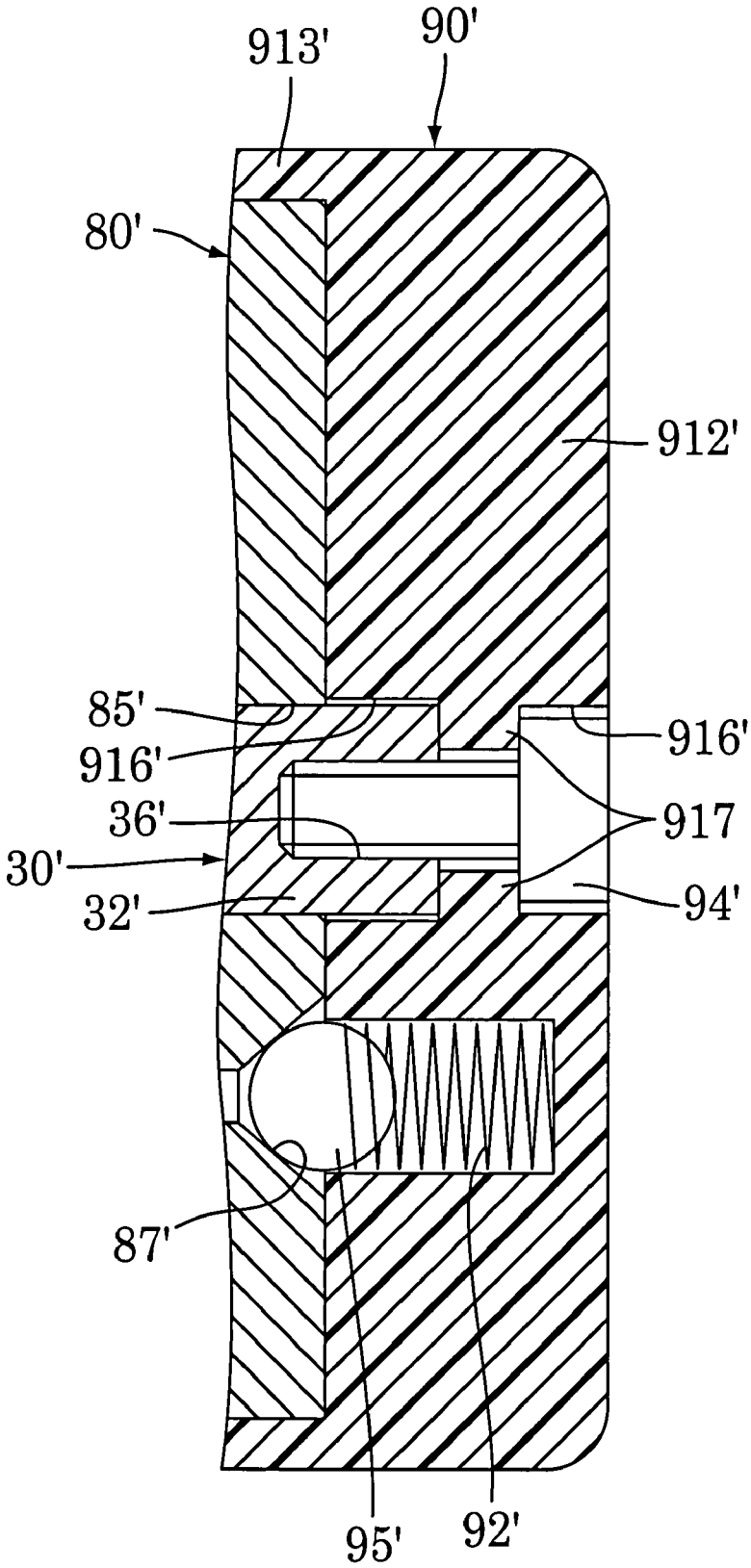
FIG. 19 is a fragmentary sectional view of the turn-indicating unit of the second embodiment.
Figure 20:
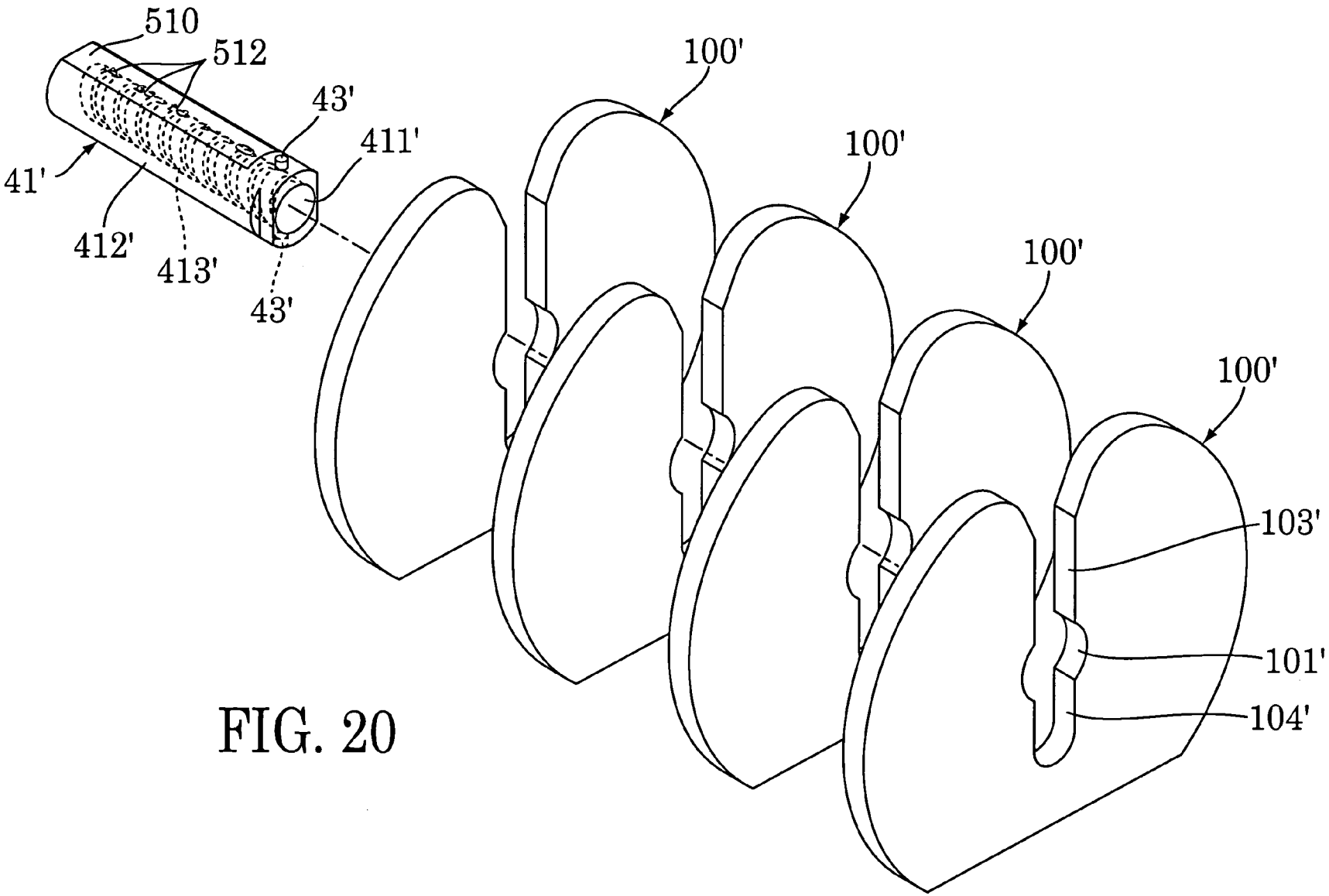
FIG. 20 is an exploded perspective view to illustrate the adjustable dumbbell of the second embodiment.

As best shown in FIGS. 18 and 19, each cap 91' includes a relatively thick plate section 912', an annular sleeve 913' that extends axially, inwardly, and integrally from an outer periphery of the plate section 912' and that is sleeved on the exterior periphery of the disk member 80'. An central hole 916' is formed in the plate section 912'. Between an enlarged inner portion and an outer portion of the hole 916', two lug like elements 917 are formed. The elements 917 are positioned and configured to engage within slots 37' when the associated screw rod or shaft 30' is engaged within the enlarged inner portion hole 916'.

Each cap 91' further includes a spring-loaded detent which has a compression spring 92' disposed in an offset hole 915' formed in the plate section 912'. A roller in the form of a ball 95' biased by the spring 92' to engage resiliently in a frusto conical positioning hole 87' formed in the outer portion of the disk member 80'. The roller 95' has a diameter larger than that of the positioning hole 87' so that the roller 95' can be easily removed from the positioning hole 87'.

After the cap 91' is sleeved on the disk member 80', a bolt 94' is passed through the central hole 916' to engage the screw hole 36' in the corresponding connecting end 32' of the associated shaft 30', so that the cap 91' is secured to the shaft 30'.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. An adjustable dumbbell assembly of the type including two sets of weights, each weight including a radial opening extending from a central area to a peripheral area and at least one transversely extending opening in the central area communicating with said radial opening, and a weight supporting assembly operable to selectively connect and disconnect the two sets of weights thereto on opposite sides of a handle, said weight supporting assembly on each side including a fixed weight entering structure, movable weight selector structure, and manually turnable actuating structure, said fixed weight entering structure being configured and positioned to enter radially within the radial openings of said weights and into an operative position with respect thereto, said movable weight selector structure being configured and positioned to enter axially in one direction into the at least one transverse opening of selected weights when said fixed structure is in the operative position thereof with respect to the weights and to withdraw axially in an opposite direction out of the at least one transverse opening of selected weights when the fixed structure is in an operative position with respect to the weights, said manually turnable actuating structure being positioned such that one of the two sets of weights is between the handle and the manually tumable actuating structure, said manually turnable actuating structure being configured to be manually grasped at the end of the side and turned in opposite directions about an axially extending turning axis coincident with a longitudinal axis of the handle, wherein when said fixed structure is in an operative position with respect to said weights, manually turning said actuating structure in one direction moves the selector structure in said one direction and manually turning said actuating structure in an opposite direction moves the selector structure in said opposite direction.

2. An adjustable dumbbell as defined in claim 1, wherein each weight includes two opposed transversely extending openings and each selector structure includes opposed portions configured to enter and withdraw from the two opposed openings of each weight.

3. An adjustable dumbbell as defined in claim 2, wherein said transversely extending openings of each weight are defined by surfaces disposed in a common cylindrical plane and each selector structure comprises a tube having an exterior cylindrical surface of a size to engage within the transversely extending opening surfaces of a weight.

4. An adjustable dumbbell as defined in claim 3, wherein said weight supporting assembly includes a central tubular structure defining said handle, a pair of inner fastening members fixed to opposite ends of said tubular structure, and a pair of outer annular fastening members spaced axially outwardly of said inner fastening members, said fixed weight entering structure at each side being fastened between inner and outer fastening members.

5. An adjustable dumbbell as defined in claim 4, wherein said fixed weight entering structure at each side includes a pair of radially spaced seats fastened between inner and outer fastening members.

6. An adjustable dumbbell as defined in claim 5, wherein each pair of seats include radially aligned axially spaced spacers configured and positioned to interengage between adjacent weights; and radially inwardly facing axial grooves, and each selector tube includes a lug extending from the exterior cylindrical surface thereof into an associated axial groove so as to limit the movement of the selector structure to axial movements in opposite directions.

7. An adjustable dumbbell assembly of the type including two sets of weights. each weight including a radial opening extending from a central area to a peripheral area and at least one transversely extending opening in the central area communicating with said radial opening, and a weight supporting assembly operable to selectively connect and disconnect the two sets of weights thereto on opposite sides of a handle, said weight supporting assembly on each side including a fixed weight entering structure, movable weight selector structure, and manually turnable actuating structure, said fixed weight entering structure being configured and positioned to enter radially within the radial openings of said weights and into an operative position with respect thereto, said movable weight selector structure being configured and positioned to enter axially in one direction into the at least one transverse opening of selected weights when said fixed structure is in the operative position thereof with respect to the weights and to withdraw axially in an opposite direction out of the at least one transverse opening of selected weights when the fixed structure is in an operative position with respect to the weights, said manually turnable actuating structure being positioned and configured to be manually grasped at the end of the side and turned in opposite directions about an axially extending turning axis, wherein when said fixed structure is in an operative position with respect to said weights, manually turning said actuating structure in one direction moves the selector structure in said one direction and manually turning said actuating structure in an opposite direction moves the selector structure in said opposite direction, wherein each weight includes two opposed transversely extending openings and each selector structure includes opposed portions configured to enter and withdraw from the two opposed openings of each weight, wherein said transversely extending openings of each weight are defined by surfaces disposed in a common cylindrical plane and each selector structure comprises a tube having an exterior cylindrical surface of a size to en a e within the transversely extending opening surfaces of a weight, wherein said weight supporting assembly includes a central tubular structure defining said handle, a pair of inner fastening members fixed to opposite ends of said tubular structure, and a pair of outer annular fastening members spaced axially outwardly of said inner fastening members, said fixed weight entering structure at each side being fastened between inner and outer fastening members, wherein said fixed weight entering structure at each side includes a pair of radially spaced seats fastened between inner and outer fastening members, wherein said manually turnable structure at each side includes a knob unit rotatably mounted on an associated outer fastening member for rotation about a common axial axis of rotation and a screw rod is fixed to each knob unit and extends inwardly along said axis of rotation, each screw rod having a threaded connection with an associated selector tube so that the turning of each screw rod in opposite directions will cause an associated selector tube to move axially in opposite directions.

8. An adjustable dumbbell as defined in claim 7, wherein the screw rods at each side form a continuous shaft having two opposite threads thereon threadedly engaging selector tubes at opposite sides.

9. An adjustable dumbbell as defined in claim 7, wherein the screw rods at each side are separate from each other.

10. An adjustable dumbbell as defined in claim 7, wherein each selector tube includes an upper surface that is formed with a weight scale with marks corresponding to the numbers of said weights supported on the weight supporting assembly, the weight supporting assembly being formed with a sight window so as to permit viewing of one of said marks that is aligned with said sight window.

11. An adjustable dumbbell as defined in claim 7, wherein said weights are configured to be supported on a separate mounting base in predetermined spaced relation with the radial openings thereof opening upwardly so that the fixed weight entering structure of said weight supporting assembly can enter the radial openings of the weights supported on said base and moved into the operative position thereof.

12. An adjustable dumbbell comprising:

a hollow handle having a connecting end;

an adjustable weight supporting assembly including:

a screw rod extending into said hollow handle, and operable to rotate relative to said hollow handle about a rotation axis, and a weight selector extending into said hollow handle and threadedly engaging said screw rod so as to be movable axially upon rotation of said screw rod about said rotation axis, said weight selector having a weight-supporting part extending outwardly through said connecting end of said hollow handle; and a plurality of weights, each of which is formed with an elongated radial opening having an enlarged central portion for extension of said weight-supporting part of said weight selector therethrough.

13. An adjustable dumbbell as defined in claim 12, wherein said weight selector is in the form of a selector tube sleeved on said screw rod and formed with an inner thread that engages threadedly said screw rod.

14. An adjustable dumbbell as defined in claim 13, wherein said selector tube has an outer surface that is formed with a weight scale with marks corresponding to the numbers of said weights supported on said weight-supporting part of said selector tube, said connecting end of said grip bar being formed with a sight window so as to permit viewing of one of said marks that is aligned with said sight window.

15. An adjustable dumbbell as defined in claim 13, wherein said adjustable weight supporting assembly further includes seats secured to said connecting end of said hollow handle, disposed outwardly of said hollow handle, defining an axially extending central channel for extension of said weight-supporting part of said selector tube thereinto, and formed with an inner limiting groove extending axially and in spatial communication with said central channel, said weight-supporting part of said selector tube being formed with a limiting protrusion that extends into said inner limiting groove in said seats so as to prevent rotation of said selector tube upon rotation of said screw rod about said rotation axis.

16. An adjustable dumbbell as defined in claim 15, wherein said adjustable weight supporting assembly further includes a fastening sleeve that has a first annular portion sleeved on said connecting end of said hollow handle, and a second annular portion enlarged in diameter from said first annular portion and defining an inner space, a fastening ring fitted into said inner space in said second annular portion of said fastening sleeve and sleeved on said connecting end of said hollow handle, and fastening screws for fastening one end of said seats to said fastening ring.

17. An adjustable dumbbell as defined in claim 16, wherein said adjustable weight supporting assembly further includes a mounting plate secured to the other end of said seats, and an operating cap sleeved rotatably on said mounting plate and connected securely to said screw rod for manually driving rotation of said screw rod.

18. An adjustable dumbbell as defined in claim 17, wherein said screw rod has a non-threaded segment extending through said central channel, and a reduced end portion that is reduced in diameter from said non-threaded segment to define a shoulder thereat, and that is formed with an inner thread, said adjustable weight supporting assembly further including a counter bolt, said operating cap being fastened to said reduced end portion of said screw rod through threaded engagement between said counter bolt and said inner thread in said reduced end portion of said screw rod.

19. An adjustable dumbbell as defined in claim 18, wherein said mounting plate is formed with a first hole, said operating cap being formed with a second hole, said weight adjusting mechanism further including a coil spring mounted in said second hole, and a ball urged and carried by said coil spring and co-rotatable with said operating cap so as to be received in said first hole when said first and second holes are axially aligned.

20. An adjustable dumbbell as defined in claim 18, wherein said operating cap is formed with a countered bore for extension of said counter bolt therethrough, said countered bore being defined by a bore-defining wall that is formed with a pair diametrically disposed lugs, said reduced end portion of said screw rod having an end formed with a pair of diametrically disposed guiding notches for extension of said lugs thereinto, respectively.

21. The dumbbell of claim 15, wherein said seats include upper and lower seats that are spaced apart from each other by a space which defines said central channel, one of said upper and lower seats being formed with said inner limiting groove, each of said upper and lower seats being formed with a plurality of spaced apart partitioning spacers that extend outwardly therefrom and that divide the respective one of said upper and lower seats into segments, said radial opening of each of said weights further having opposite upper and lower portions that are reduced in width from said enlarged central portion, two adjacent ones of said weights cooperatively defining a gap therebetween, each of said partitioning spacers of each of said upper and lower seats extending into said gap between two adjacent ones of said weights, each of said segments of each of said upper and lower seats being received in a respective one of said upper and lower portions of said radial opening in a respective one of said weights.

22. An adjustable dumbbell as defined in claim 12, wherein said connecting end constitutes a first connecting end and said hollow handle has a second connecting end positioned so that said first and second connecting ends are on opposite first and second sides of said hollow handle, respectively, said second side having a screw rod extending into said hollow handle and operable to rotate relative to said handle about said rotation axis, said second side also having a second weight selector extending into said hollow handle and threadly engaged with said second side screw rod so as to be movable axially upon rotation of said second side screw rod about said rotational axis, said second weight selector having a second weight-supporting part extending outwardly through said second connecting end of said hollow handle, said plurality of weights includes first and second groups of weights associated with the first and second sides of said hollow handle.

23. An adjustable dumbbell as defined in claim 22, wherein said second side screw rod is integral with said first mentioned screw rod and has an oppositely directed threaded engagement with the second weight selector.

24. An adjustable dumbbell as defined in claim 22, wherein said secured side screw rod is separate from said first mentioned screw rod.

25. An adjustable dumbbell as defined in claim 22, wherein said enlarged central portion of each weight comprises opposed arcuate openings extending into said radial opening and said weight selector constitute tubes having cylindrical exterior peripheries opposite arcuate portions of which constitute the associated weight supporting part.

26. An adjustable dumbbell as defined in claim 22, wherein said first and second group of weights are configured to be supported on a separate mounting base in predetermined space relation with the radial openings thereof opening upwardly.

* * * * *

UNITED STATES PATENT AND TRADEMARK OFFICE

CERTIFICATE OF CORRECTION

PATENT NO. : 7,604,577 B2
APPLICATION NO. : 11/702673
DATED : October 20, 2009
INVENTOR(S) : Lin It is certified that error appears in the above-identified patent and that said Letters Patent is hereby corrected as shown below:

Title Page
Please add the following:

--(30) Foreign Application Priority Data

November 17, 2006 (CN) .....200620157998.7--

Signed and Sealed this

First Day of June, 2010

David J. Kappos

David J. Kappos
*Director of the United States Patent and Trademark Office*